US011125421B2

(12) United States Patent
Cacciabeve

(10) Patent No.: US 11,125,421 B2
(45) Date of Patent: Sep. 21, 2021

(54) CLAMPING WORK LIGHT

(71) Applicant: Walter R. Tucker Enterprises, Ltd., Deposit, NY (US)

(72) Inventor: Robert Cacciabeve, Boonton, NJ (US)

(73) Assignee: Walter R. Tucker Enterprises, Ltd., Deposit, NY (US)

( * ) Notice: Subject to any disclaimer, the term of this patent is extended or adjusted under 35 U.S.C. 154(b) by 0 days.

(21) Appl. No.: 16/829,922

(22) Filed: Mar. 25, 2020

(65) Prior Publication Data

US 2020/0309355 A1 Oct. 1, 2020

Related U.S. Application Data

(63) Continuation-in-part of application No. 29/685,652, filed on Mar. 29, 2019.

(60) Provisional application No. 62/826,032, filed on Mar. 29, 2019.

(51) Int. Cl.

| | |
|---|---|
| ***F21V 21/088*** | (2006.01) |
| ***F21L 4/04*** | (2006.01) |
| ***F21V 21/28*** | (2006.01) |
| ***F21Y 115/10*** | (2016.01) |
| ***F21V 23/06*** | (2006.01) |

(52) U.S. Cl.

CPC ..... *F21V 21/088* (2013.01); *F21L 4/04* (2013.01); *F21V 21/28* (2013.01); *F21V 23/06* (2013.01); *F21Y 2115/10* (2016.08)

(58) Field of Classification Search

CPC ..... F21V 21/088; F21V 21/28; F21V 23/06; F21L 4/04; F21Y 2115/10

USPC ..... 362/371

See application file for complete search history.

(56) References Cited

U.S. PATENT DOCUMENTS

| | | | | |
|---|---|---|---|---|
| 6,585,400 | B2 | 7/2003 | Leon | |
| 7,040,783 | B1 | 5/2006 | Christianson | |
| 7,478,917 | B2 | 1/2009 | Yu | |
| 7,850,329 | B2 | 12/2010 | Henry et al. | |
| 8,087,797 | B2 | 1/2012 | Pelletier et al. | |
| 8,142,045 | B2 | 3/2012 | Peak | |
| 8,262,246 | B2 | 9/2012 | Pelletier et al. | |
| 8,360,597 | B1 * | 1/2013 | Hanchett | F21L 4/005 362/190 |
| 8,764,253 | B2 | 7/2014 | Ko et al. | |
| 8,840,264 | B2 | 9/2014 | Molina et al. | |
| 8,911,103 | B2 | 12/2014 | Matthews et al. | |
| D737,487 | S | 8/2015 | Beckett et al. | |
| 9,115,878 | B2 | 8/2015 | Ancona et al. | |

(Continued)

FOREIGN PATENT DOCUMENTS

CA 2682159 A1 * 9/2010 ..... F21V 21/406

OTHER PUBLICATIONS

DeWalt 20-Volt MAX Cordless LED Worklight, https://www.homedepot.com, Jan. 1, 2019, 4 Pages.

(Continued)

*Primary Examiner* — Andrew J Coughlin
*Assistant Examiner* — Jessica M Apenteng
(74) *Attorney, Agent, or Firm* — Breiner & Breiner, L.L.C.

(57) ABSTRACT

The invention relates to a clamping work light. More particularly, the invention relates to a work light that has a housing with a clamping mechanism designed into the housing and which allows the light to nest into the housing or rotate out of the housing and the light may be aimed in any direction by a double-axis pivoting assembly.

17 Claims, 27 Drawing Sheets

(56) References Cited

U.S. PATENT DOCUMENTS

| | | | | |
|---|---|---|---|---|
| D786,660 | S | 5/2017 | Cacciabeve | |
| 2009/0279290 | A1* | 11/2009 | Henry | F21V 21/406 362/191 |
| 2012/0033412 | A1* | 2/2012 | Molina | F21V 21/088 362/119 |
| 2014/0029253 | A1* | 1/2014 | Auyeung | F21S 4/28 362/235 |
| 2014/0126192 | A1 | 5/2014 | Ancona et al. | |
| 2015/0267902 | A1 | 9/2015 | Zhang | |
| 2017/0075194 | A1* | 3/2017 | Kim | G03B 15/05 |
| 2017/0314769 | A1 | 11/2017 | Cacciabeve | |
| 2019/0093867 | A1 | 3/2019 | Qiu | |
| 2019/0093876 | A1* | 3/2019 | Proeber | F21L 4/02 |
| 2019/0234587 | A1 | 8/2019 | Ohara et al. | |

OTHER PUBLICATIONS

Lutec 1500-Lumen Portable Integrated LED Work Light, https://homedepot.com, Jan. 1, 2019, 5 Pages.
Ridgid LED Lighting Solutions, https://www.toolboxbuzz.com, Jan. 1, 2019, 14 Pages.
Klein Tools, Clamp Work Light, https://www.google.com, Jul. 7, 2020, 6 Pages.
Stanley Heavy Duty Clamping Flashlight, https://toolgyd.com, Jul. 7, 2020, 7 Pages.
Craftsman 3000-Lumen LED Portable Work Light, https://lowes.com, Jul. 7, 2020, 10 Pages.
Blackfire Clamp Light Mini + LED Work Light, https://www.homedepot.com, Jul. 6, 2020, 3 Pages.

* cited by examiner

CLAMPING WORK LIGHT

RELATED APPLICATIONS

This application claims benefit of U.S. Provisional Application Ser. No. 62/826,032, filed Mar. 29, 2019, entitled "Clamping Work Light," and is a continuation-in-part of U.S. application Ser. No. 29/685,652, filed Mar. 29, 2019, entitled "Clamping Work Light," which applications are incorporated herein by reference in their entireties.

FIELD OF THE INVENTION

The invention relates to a clamping work light. More particularly, the invention relates to a work light that has a housing with a clamping mechanism designed into the housing and which allows the light to nest into the housing or rotate out of the housing and the light may be aimed in any direction by a double-axis pivoting assembly.

BACKGROUND OF THE INVENTION

Homeowners, garage mechanics and the like often require a light source for the work area or other environment of use ("work area"). The light source must be capable of being directed to the work area and configured such that the worker does not need to hold the work light. For example, the E-Z Red Company has sold a clamp with a light as shown, for example, in U.S. Design Pat. No. D786,660. While this clamp with light has been useful, there is always room for improvement. The present invention provides a further improved clamping work light.

SUMMARY OF THE INVENTION

A primary object of the invention is to provide a clamping work light.

Another primary object of the invention is to provide a clamping work light for attachment to an object or which is free standing.

Another primary object of the invention is to provide a clamping work light having a clamp which is easily attached to a surface adjacent a work area.

Another primary object of the invention is to provide a clamping work light that has a housing with a clamping mechanism designed into the housing and which allows the light to nest into the housing or rotate out of the housing and be aimed in any direction by a double-axis pivoting assembly. The housing protects the light member when in the nested position and also reduces the size of the light for easy storage.

Another primary object of the invention is to provide a clamping work light having a housing designed to transform into a clamping member to easily attach to any surface and having the ability to act as a stand for the light.

Another primary object of the invention is to provide a clamping work light having a double-axis pivoting assembly which allows the light to be placed in multiple positions and, therefore, direct the light to the work area from these multiple positions. After moving the light from a nesting position in the housing, the light may be directed up or down on a first axis and the light may be rotated 360 degrees on a second axis.

Another primary object of the invention is to provide a clamping work light that may be clamped to most any angle surface. The clamping member may include swivel feet having a pivot mechanism to adjust to any angle for clamping the light to a surface. There is a cross-check pattern on the swivel feet which will securely hold the light to flat or round surfaces such as pipes or 2x4s.

Another primary object of the invention is to provide a clamping work light that in one embodiment may be locked into a preset position for the light to stand securely on its own (without clamping) adjacent to a work area and direct light to the work area. The locking feature is very practical and user friendly. The lock is designed in a way that the clamp will not accidentally lock open and the clamp may be expanded as wide as possible when functioning as a clamp.

Another primary object of the invention is to provide a clamping work light having a bezel surrounding the light lens which provides an ornamental aesthetically pleasing frame around the light lens and also functions as a protective guard for the light lens.

Another primary object of the invention is to provide a clamping work light that in another embodiment when rotating the light out of the nesting position the clamping legs may be pulled from each side to open the legs such that a user may clamp the legs onto extra wide or small surfaces.

Another primary object of the invention is to provide a clamping work light which provides hands free lighting and allows the light to be clamped to an object or to stand and direct light to a work area.

The clamping work light invention comprises a housing having a first leg and second leg allowing for the nesting of a light. The light may be pivoted from the nesting position to a non-nesting position along a first pivoting axis to multiple positions. The light may be rotated 360 degrees on a second axis to multiple positions. The housing may function as a clamp to clamp the light to an object or function as a stand to provide a free-standing light.

These primary and other objects of the invention will be apparent from the following description of the preferred embodiments of the invention and from the accompanying drawings.

BRIEF DESCRIPTION OF THE DRAWINGS

The following detailed description of the specific non-limiting embodiments of the present invention can be best understood when read in conjunction with the following drawings, where like structures are indicated by like reference numbers unless otherwise stated.

Referring to the drawings.

DETAILED DESCRIPTION OF THE PREFERRED EMBODIMENTS

The present invention is directed to a clamping work light. The invention may be used to direct light to a work area. The clamping work light includes a housing with a clamping mechanism designed into the housing and which allows the light to nest into the housing or rotate out of the housing and the light may be aimed in any direction by a double-axis pivoting assembly. The clamping work light invention provides for hands free lighting and allows for directing the light to a specific work area. The light may be a rechargeable light or a battery operated light or a corded light. Two presently preferred embodiments of the clamping work light are disclosed, namely, a first embodiment in FIGS. 1-20 and a second embodiment in FIGS. 21-28.

Figure 1:
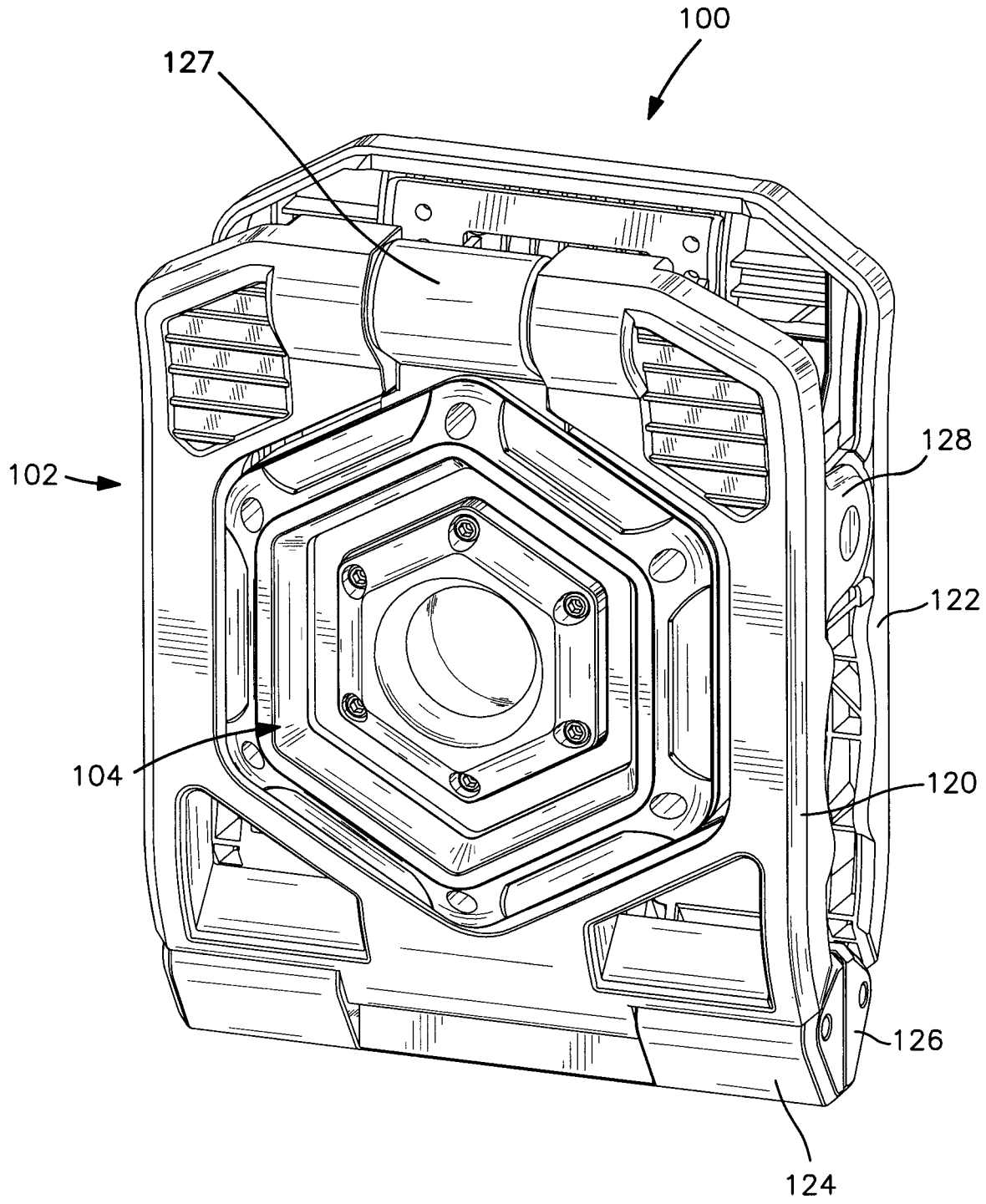
FIG. 1 is a front/side elevational perspective view of the clamping work light with the light in a nested position.
Figure 2:
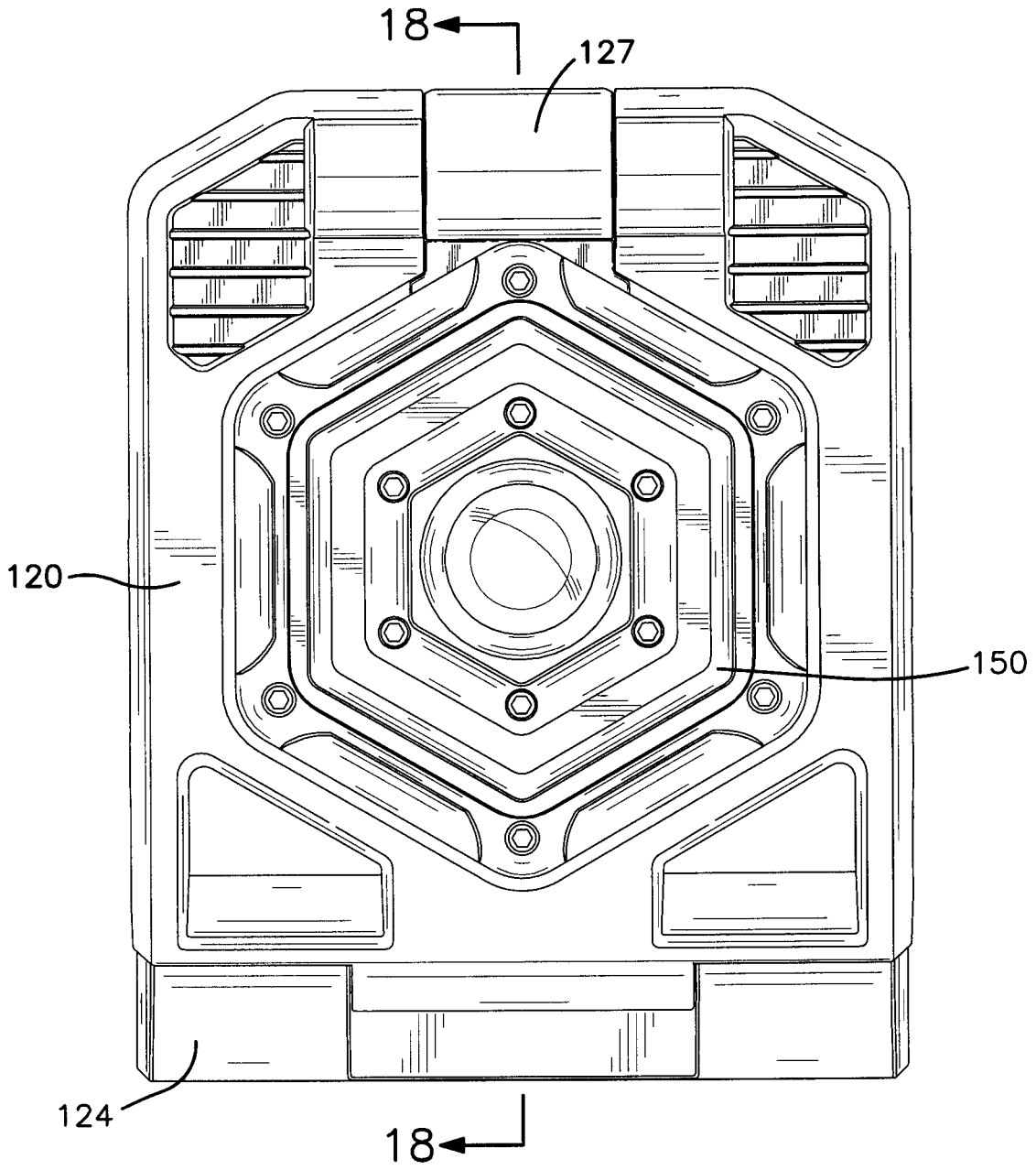
FIG. 2 is a front view of the clamping work light of FIG. 1.
Figure 3:
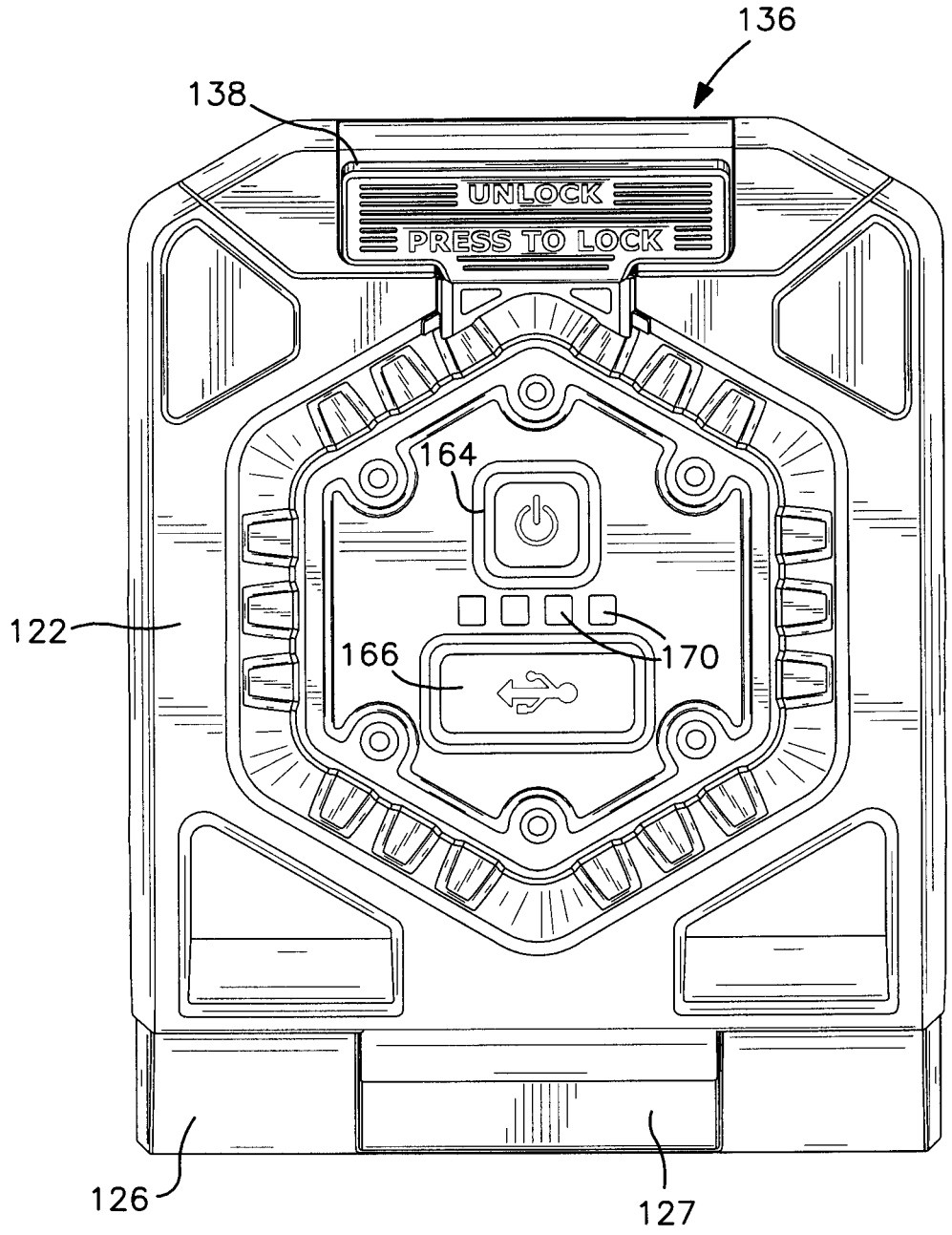
FIG. 3 is a rear view of the clamping work light of FIG. 1.
Figure 4:
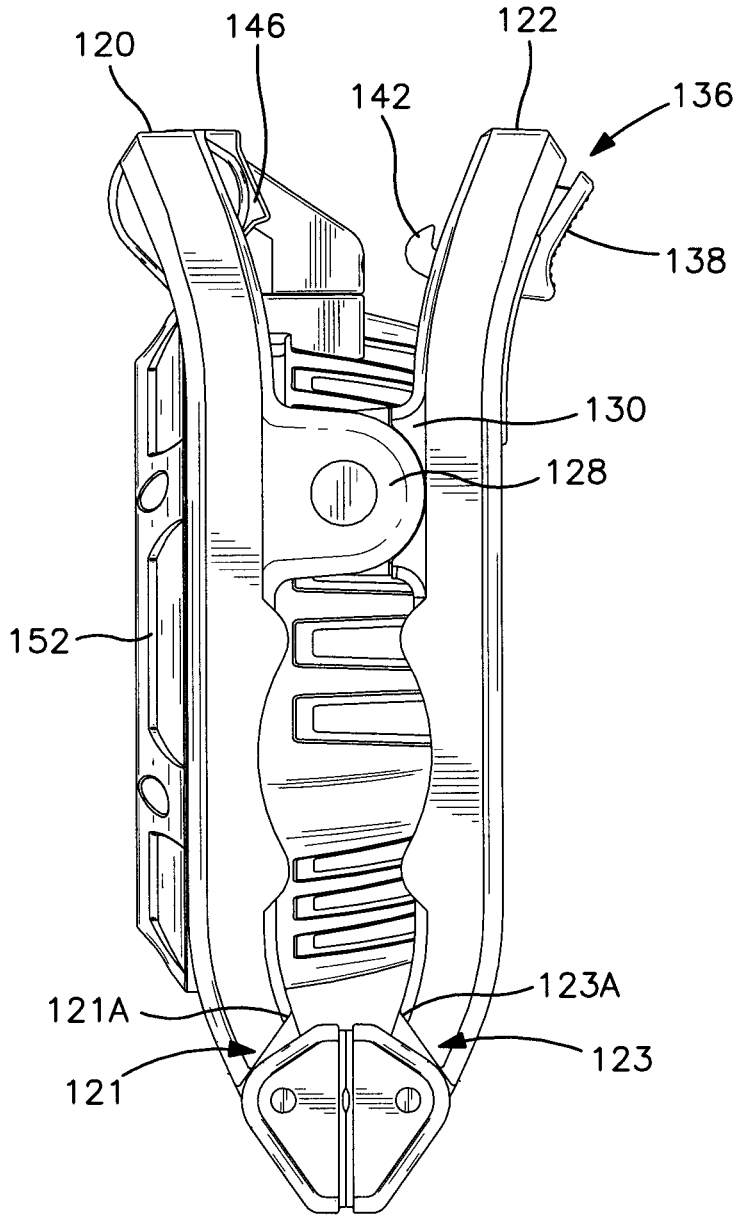
FIG. 4 is a side view of the clamping work light of FIG. 1, the opposite side view being a mirror image.
Figure 5:
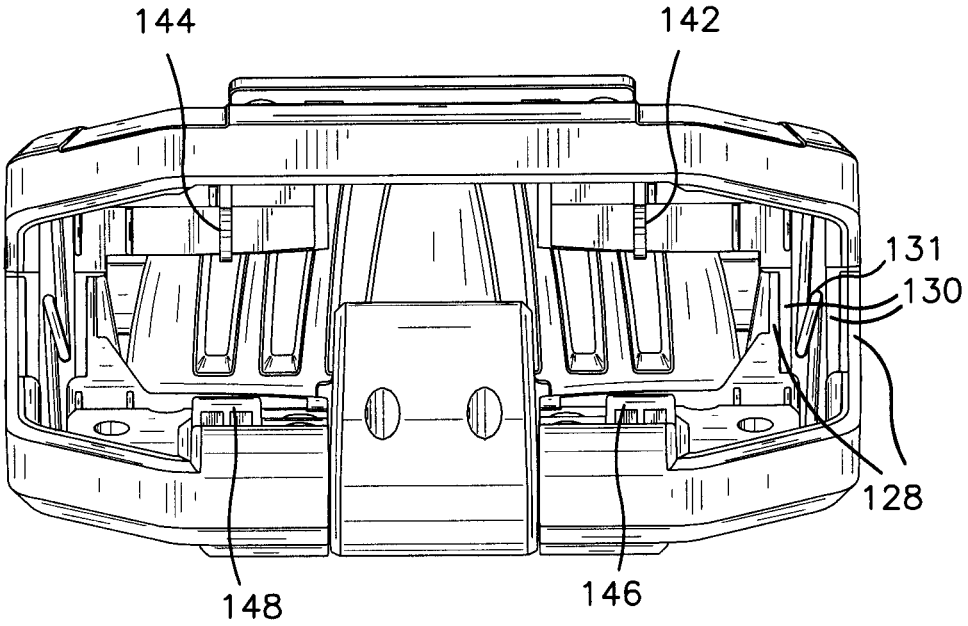
FIG. 5 is a top view of the clamping work light of FIG. 1.
Figure 6:
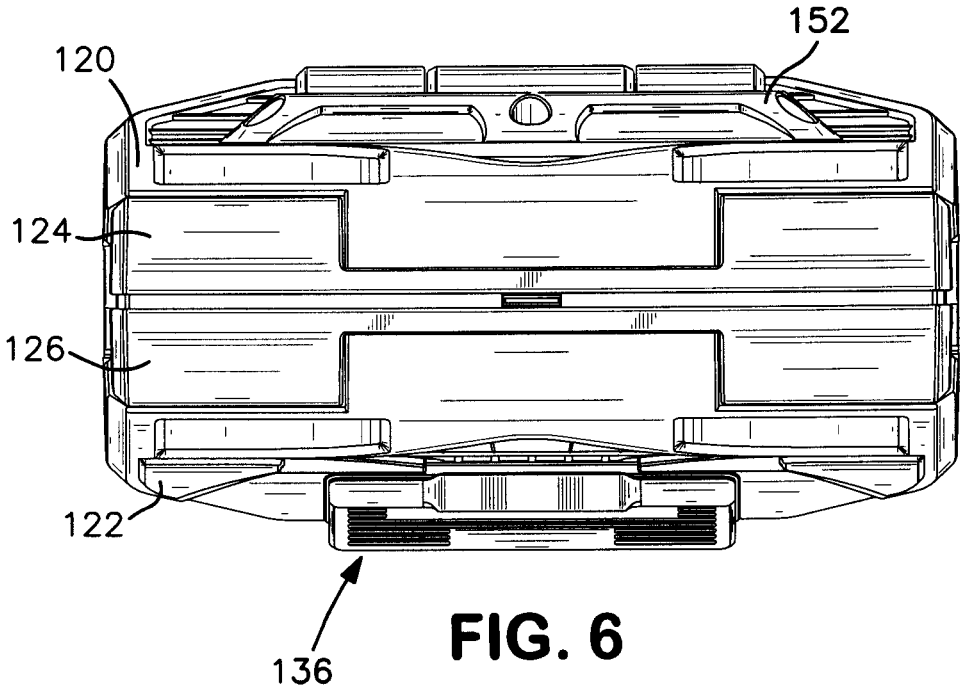
FIG. 6 is a bottom view of the clamping work light of FIG. 1.
Figure 7:
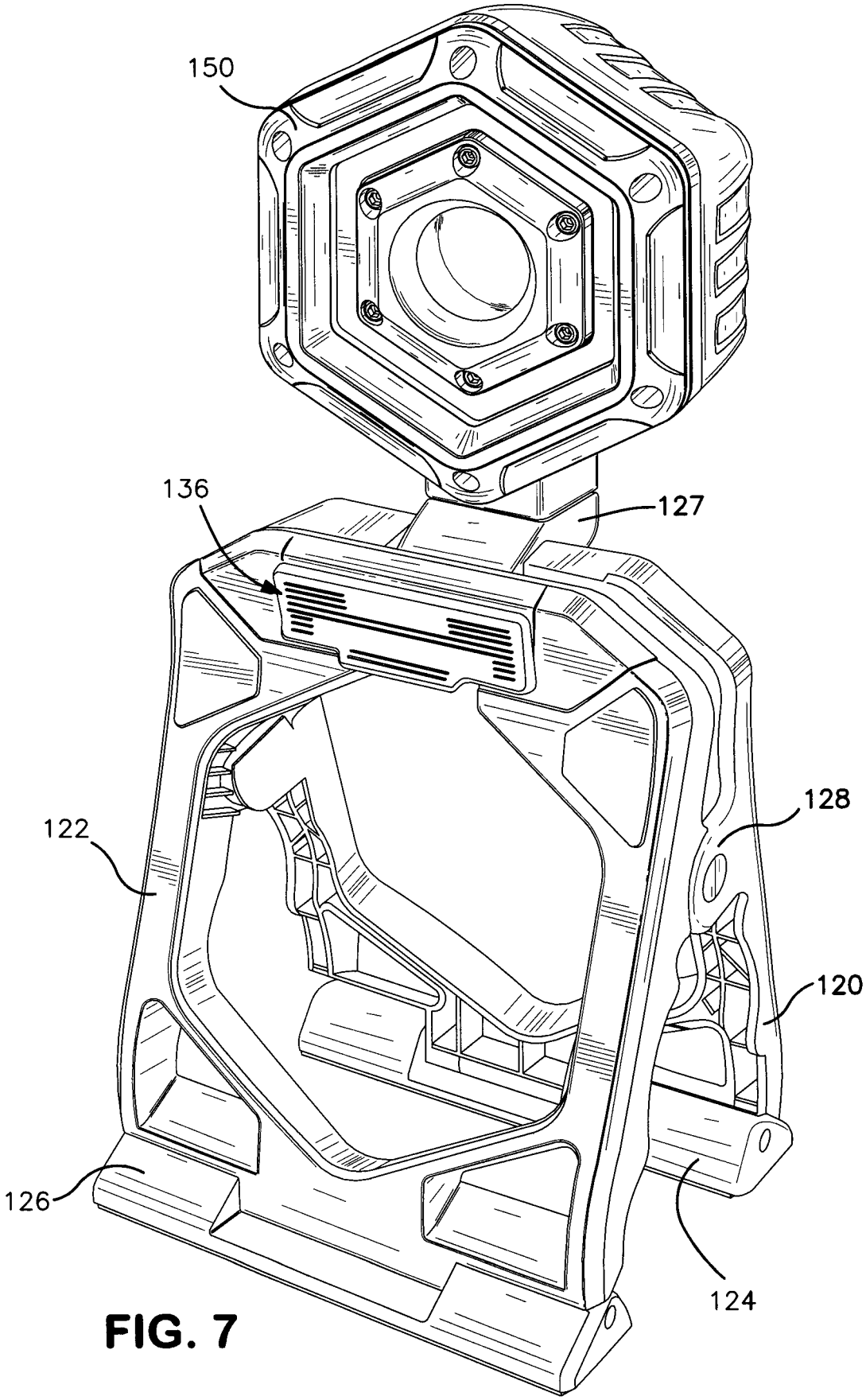
FIG. 7 is a perspective view of the clamping work light of FIG. 1 with the light in a first non-nested position and the housing in a locked standing position.
Figure 8:
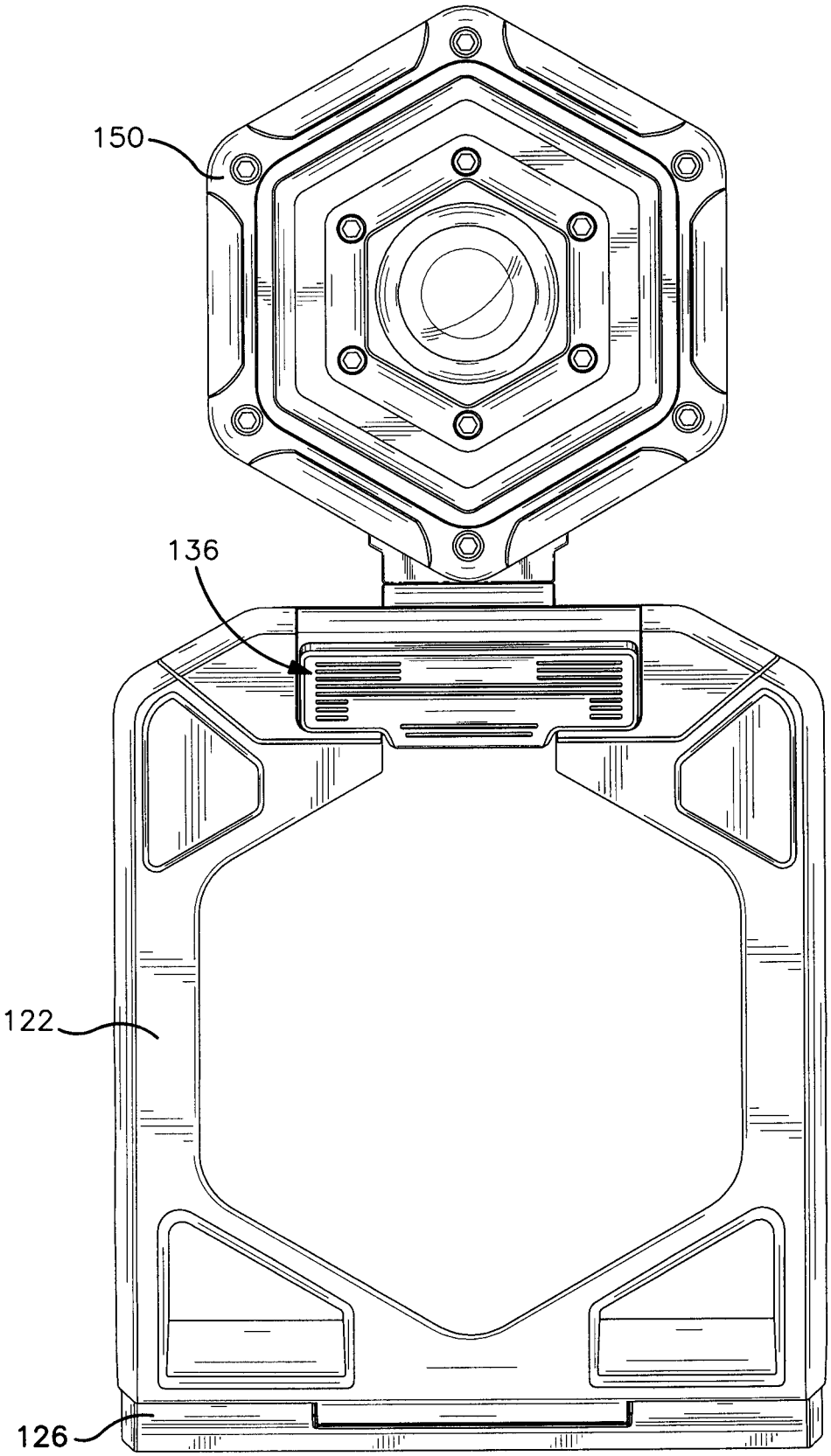
FIG. 8 is a rear view of the clamping work light of FIG. 7.
Figure 9:
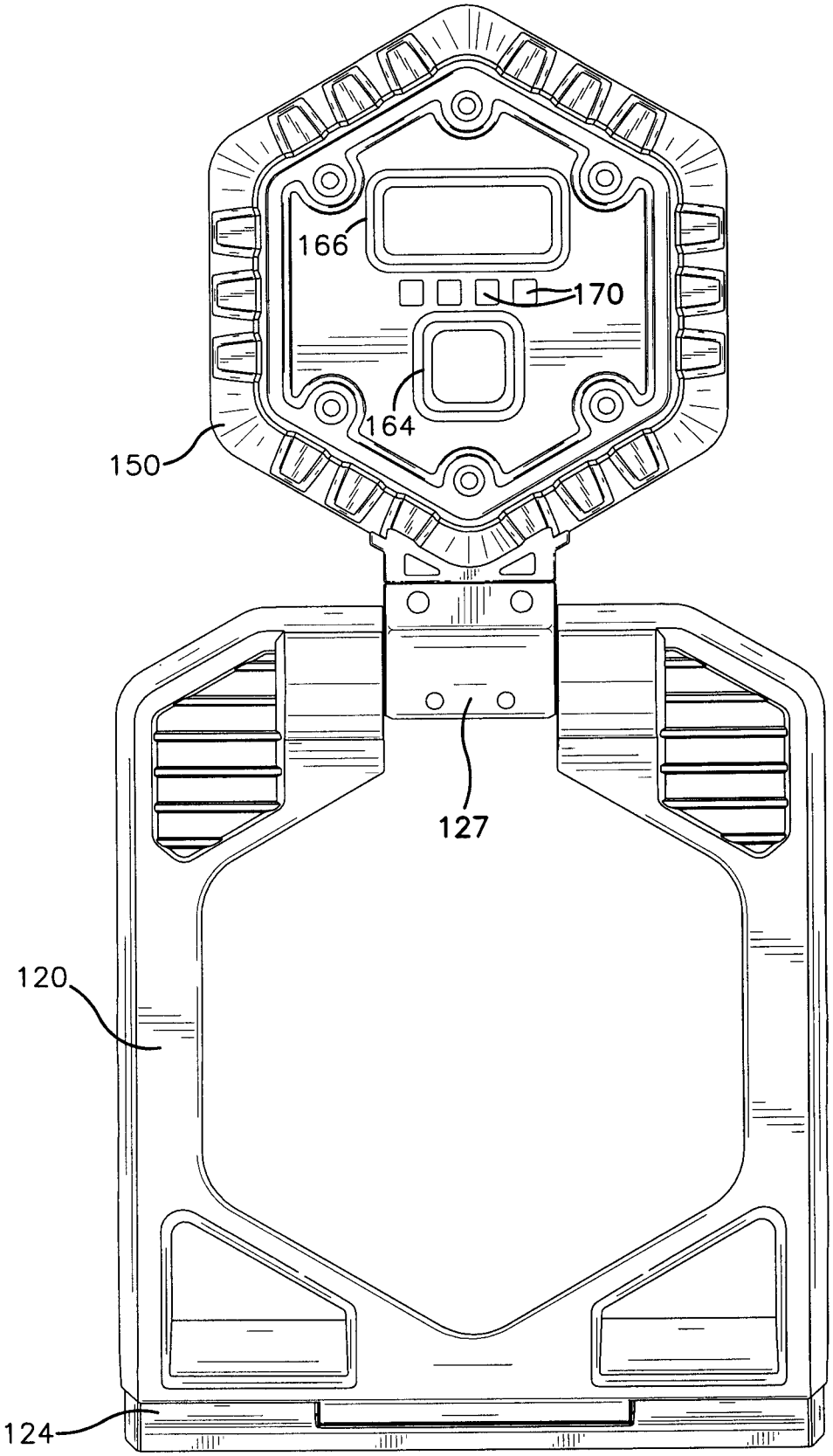
FIG. 9 is a front view of the clamping work light of FIG. 7.
Figure 10:
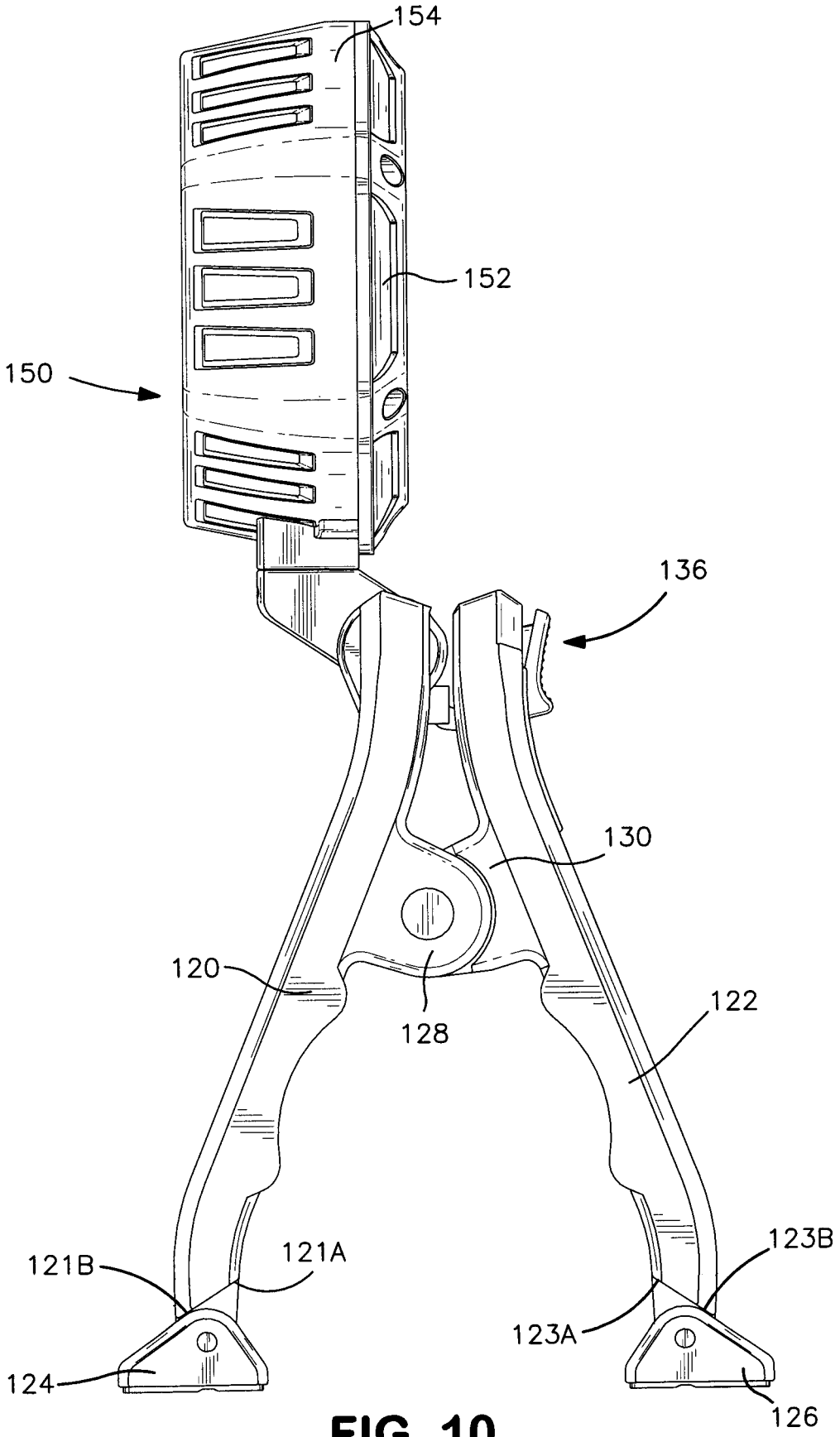
FIG. 10 is a side view of the clamping work light of FIG. 7, the opposite side view being a mirror image.
Figure 11:
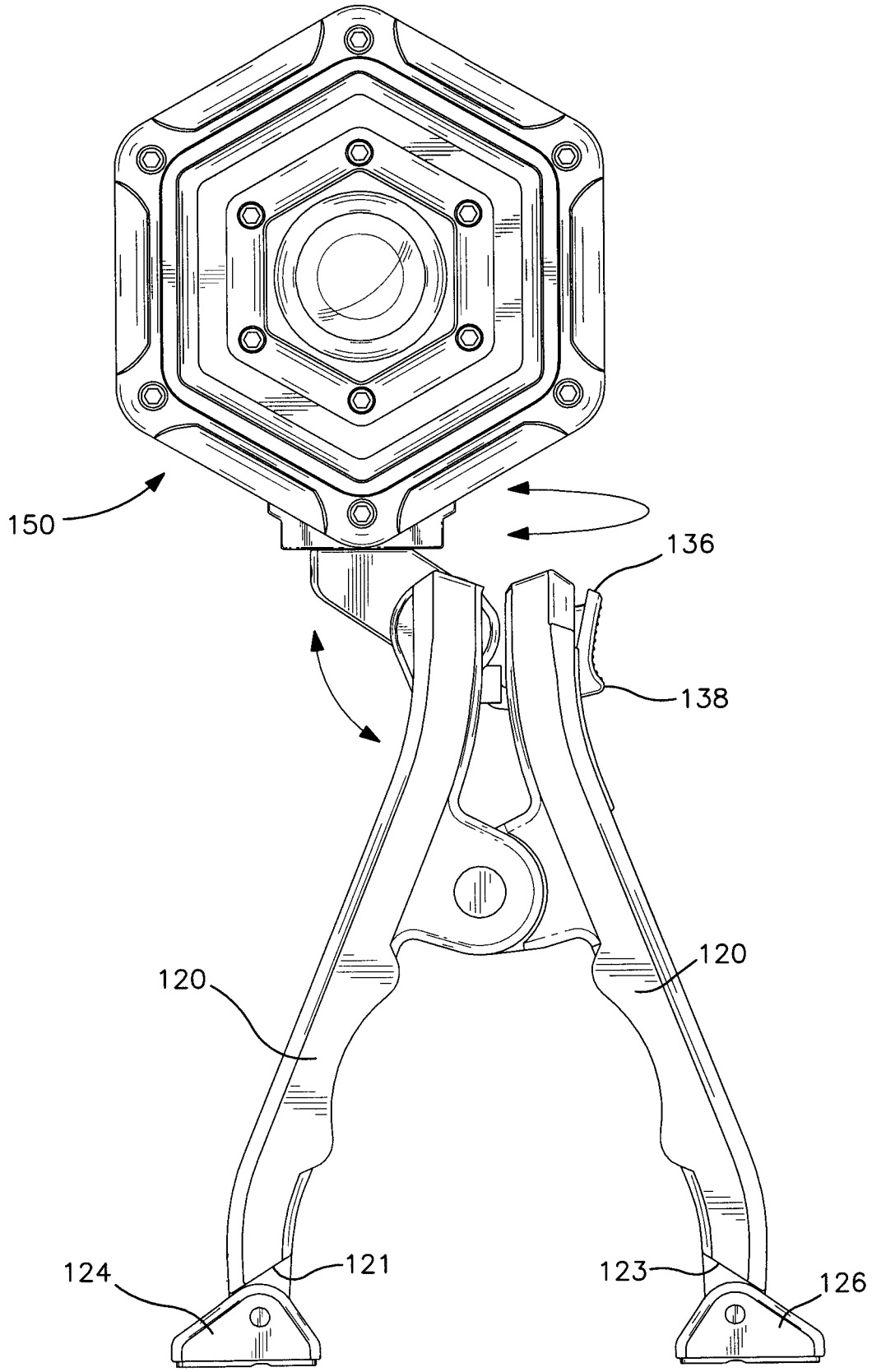
FIG. 11 is a side view of the clamping work light of FIG. 7 with the light rotated.
Figure 12:
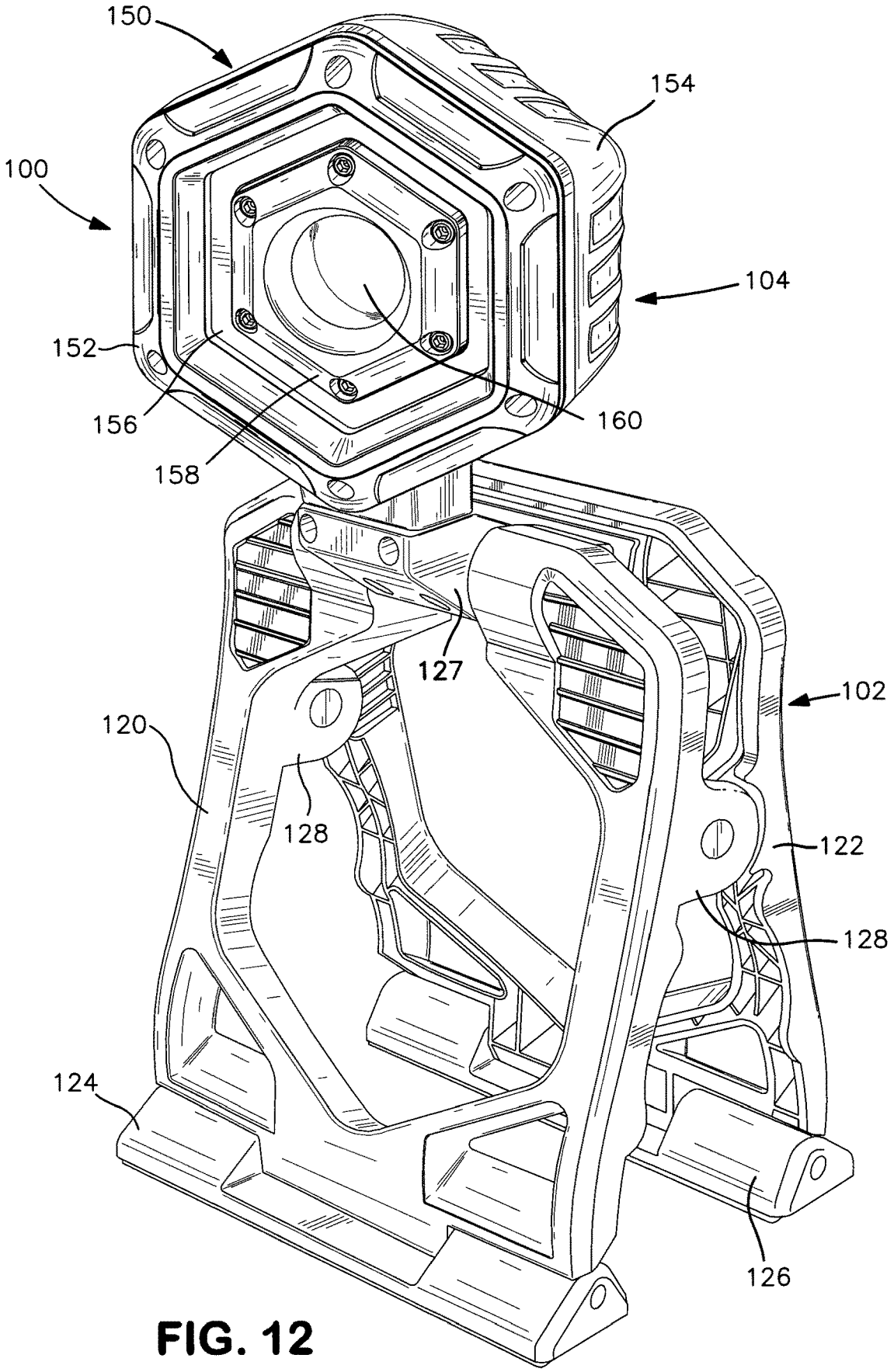
FIG. 12 is a perspective view of the clamping work light of FIG. 1 with the light in a second non-nested position and the housing in a locked standing position.
Figure 13:
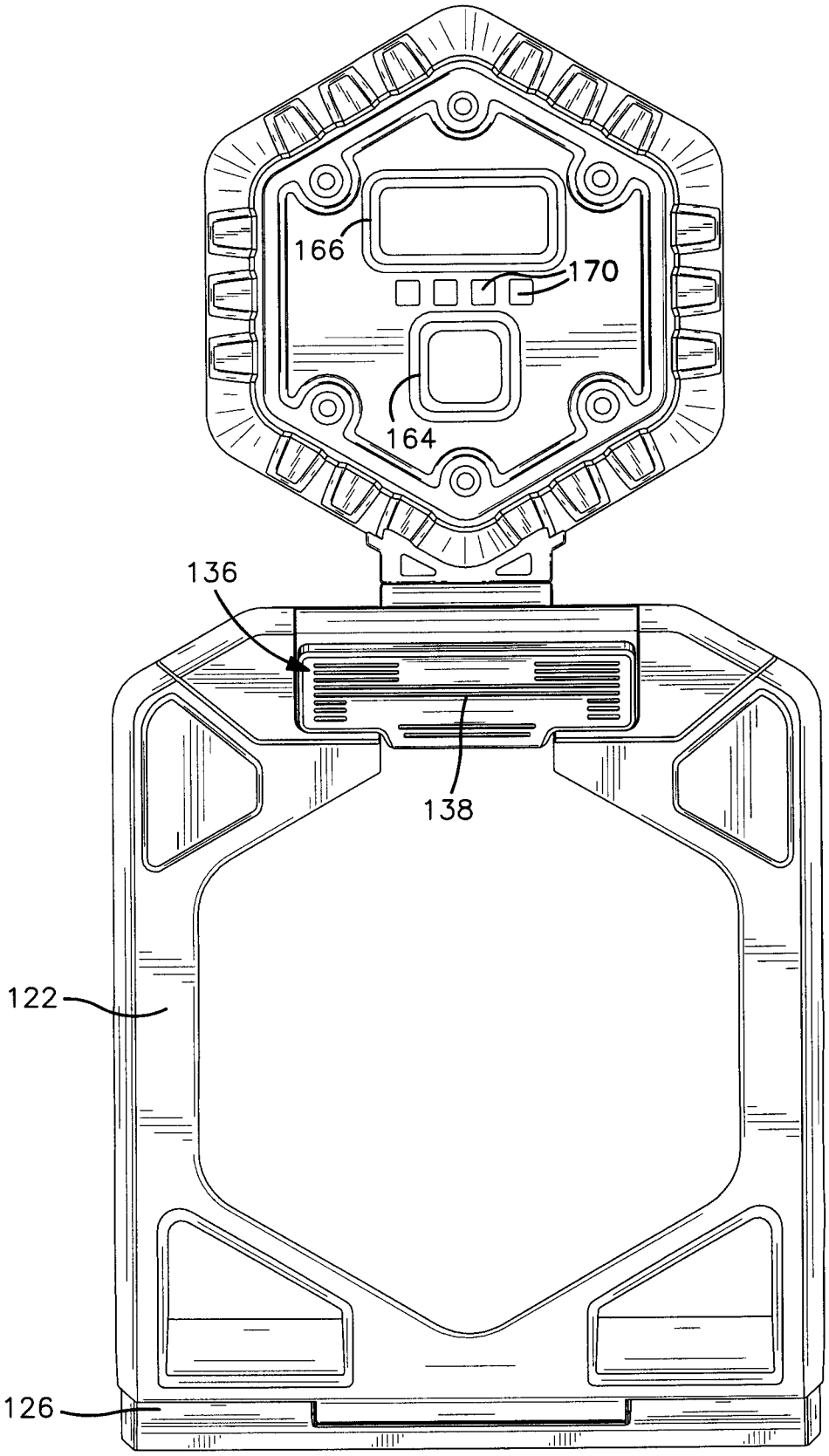
FIG. 13 is a rear view of the clamping work light of FIG. 12.
Figure 14:
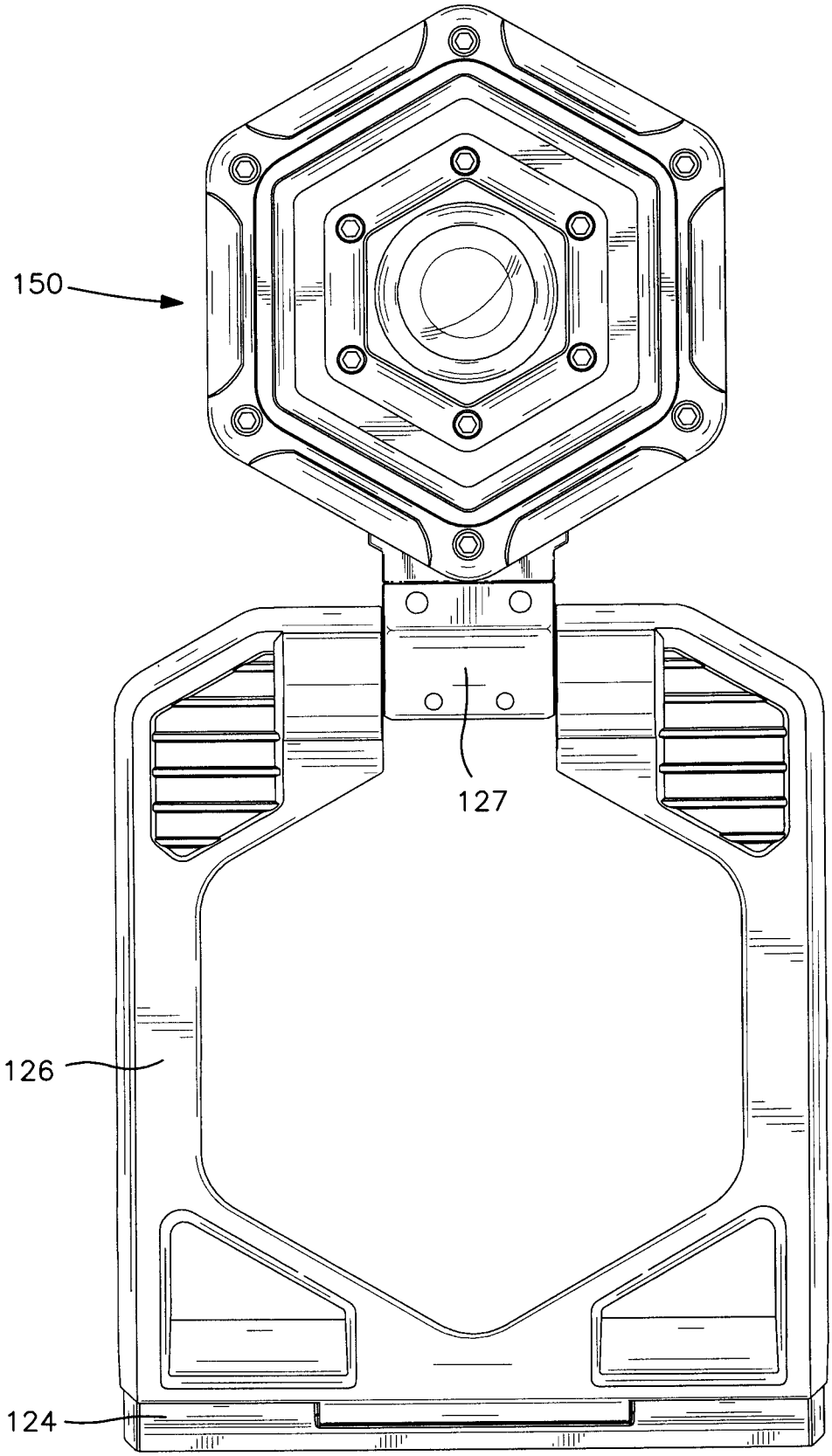
FIG. 14 is a front view of the clamping work light of FIG. 12.
Figure 15:
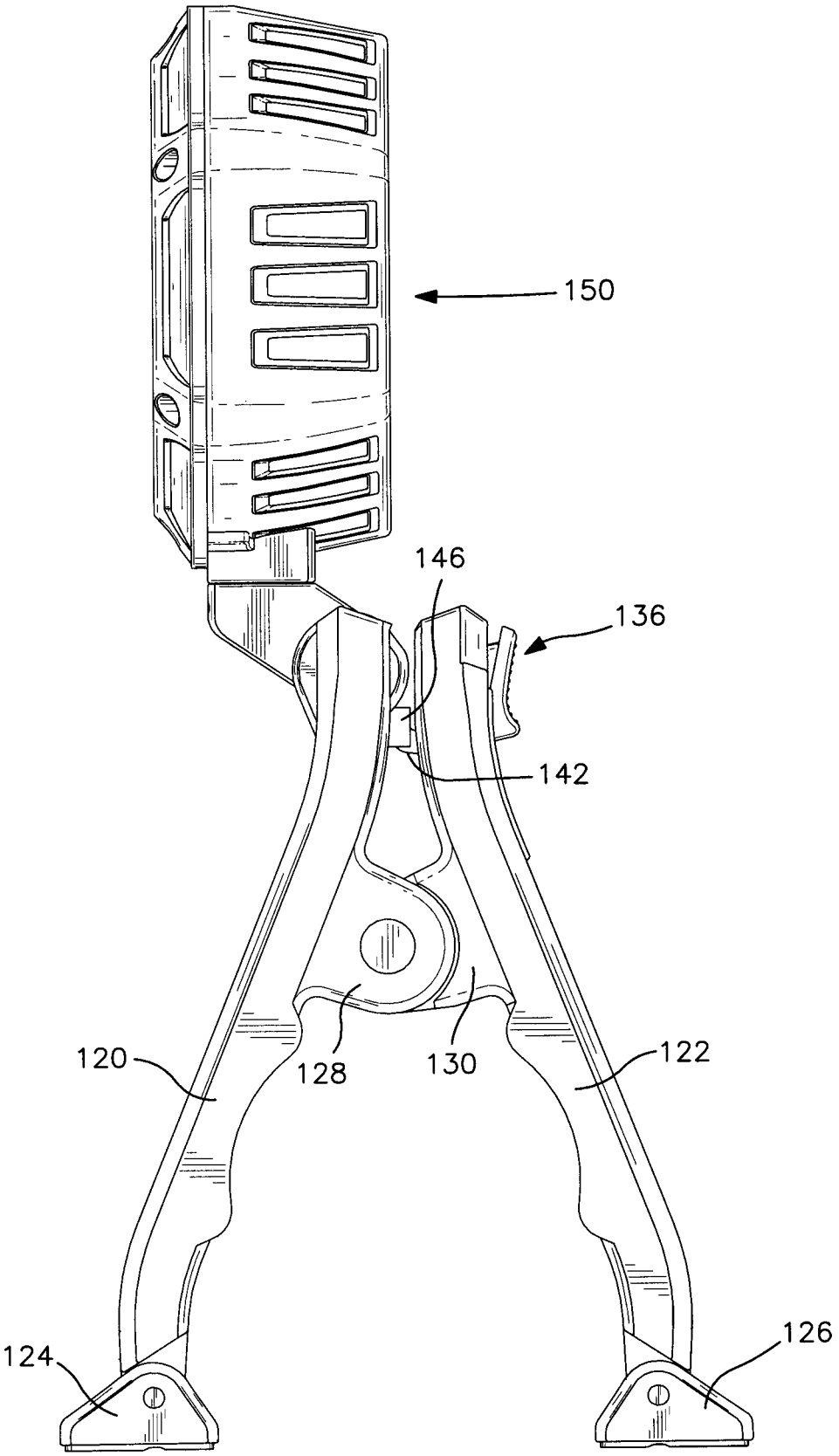
FIG. 15 is a side view of the clamping work light of FIG. 12, the opposite side view being a mirror image.
Figure 16:
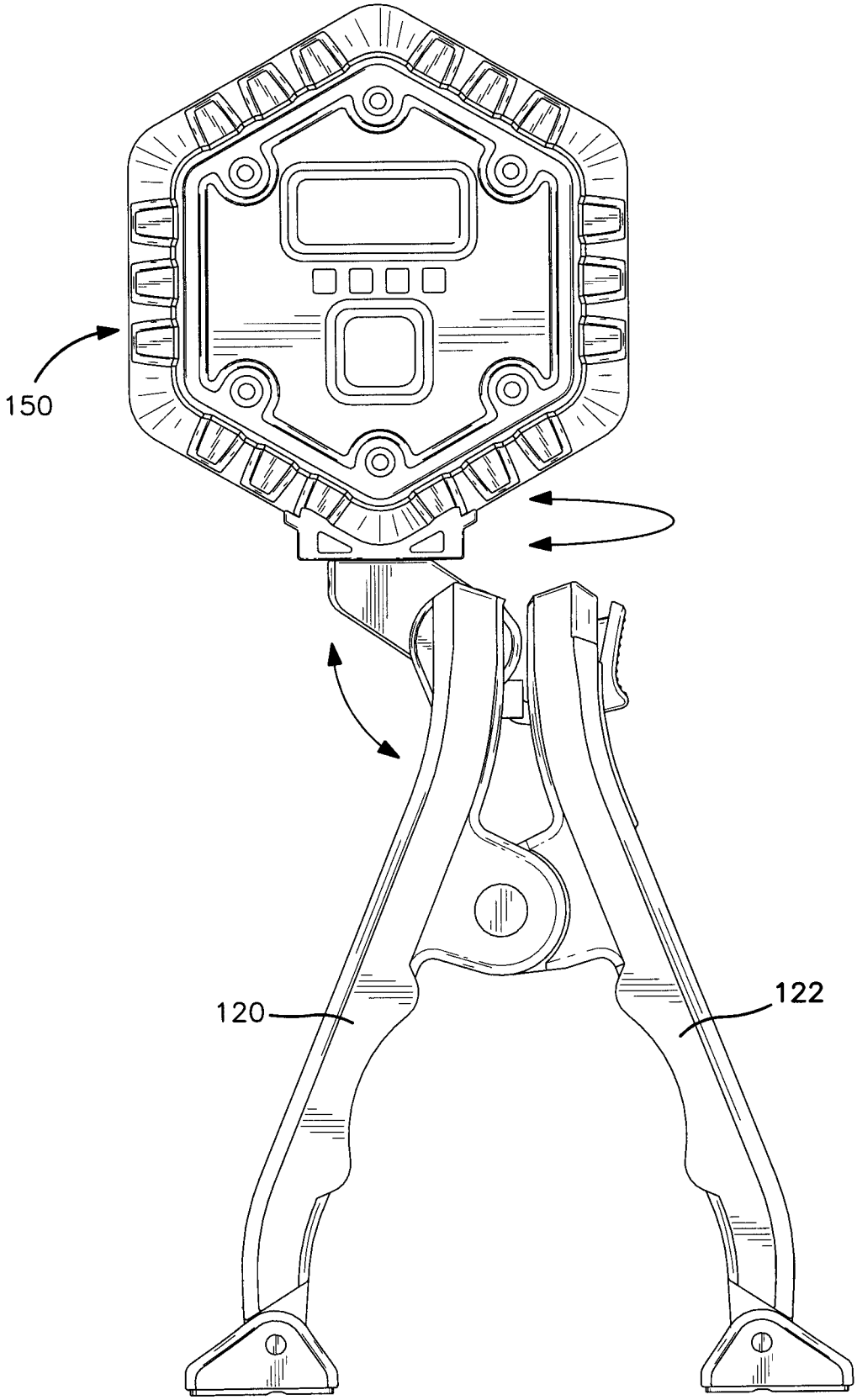
FIG. 16 is a side view of the clamping work light of FIG. 12 with the light rotated.
Figure 17:
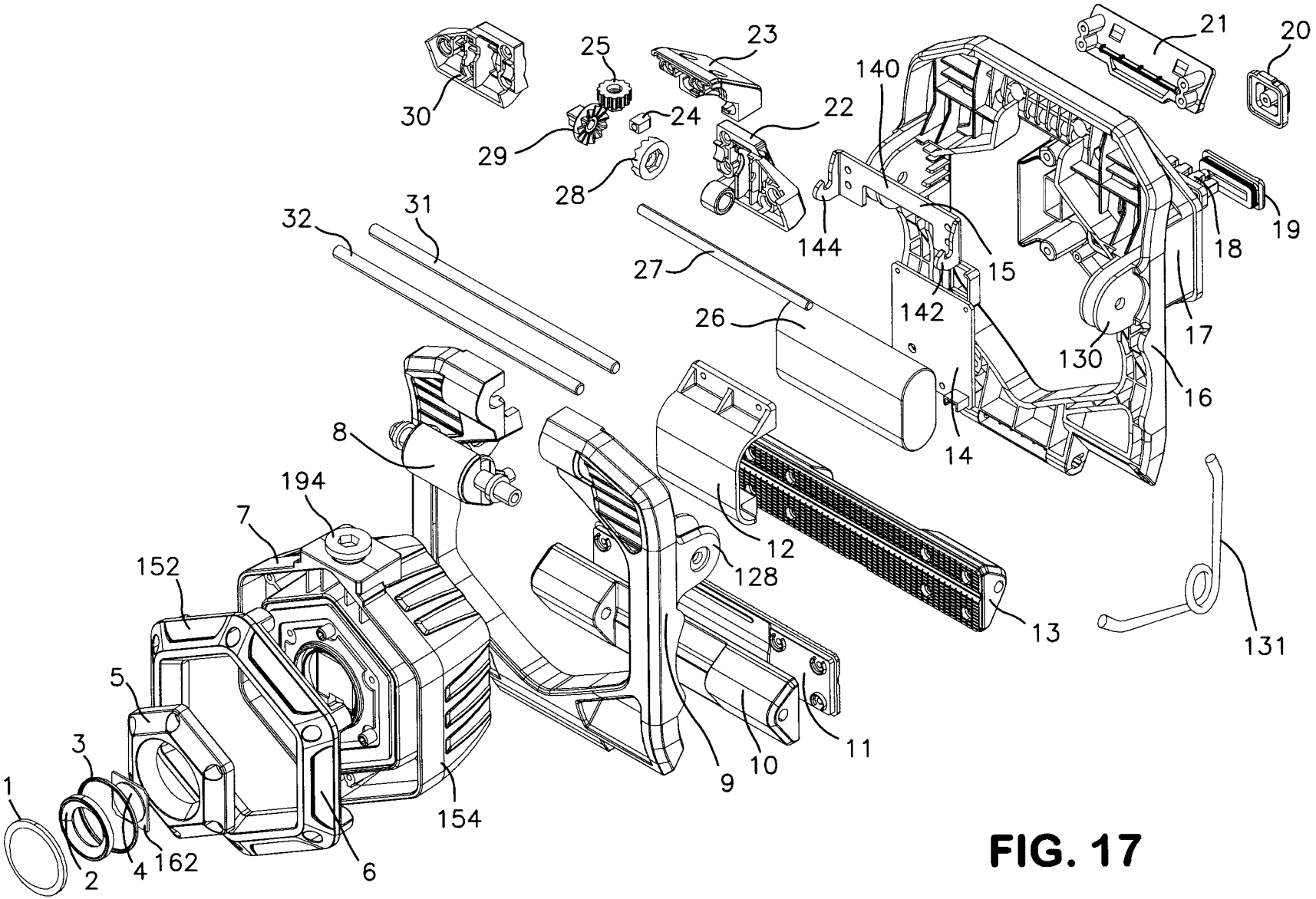
FIG. 17 is an exploded view of the clamping work light of FIG. 1.
Figure 18:
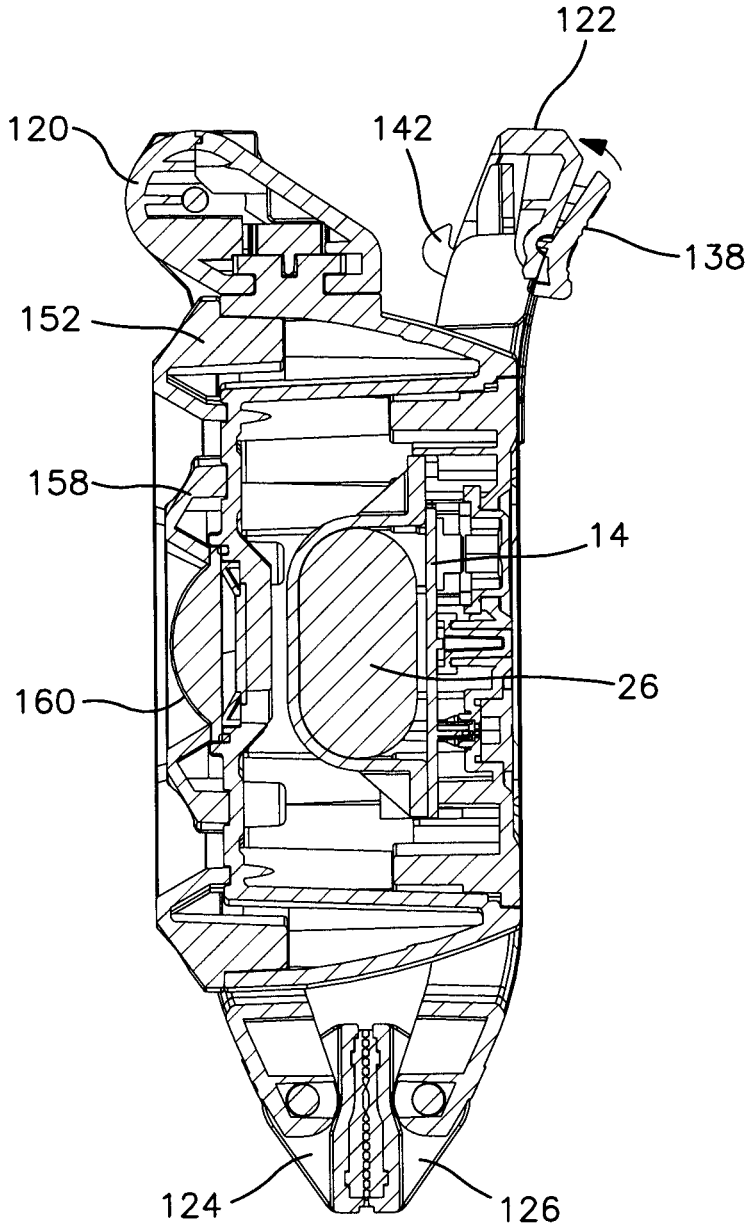
FIG. 18 is a cross-section of the clamping work light of FIG. 2 taken along line 18-18.

Referring to FIG. 17, there is shown an exploded view of a clamping work light of FIGS. 1-20. This exploded view includes components of the working clamp light and the method of construction of the working clamp light. The components of the light as shown in FIG. 17 include the following:

1. LENS
2. REFLECTOR
3. O-RING
4. COB LED LIGHT SOURCE
5. HEX LENS BEZEL
6. LARGE BEZEL/FRONT COVER
7. ALUMINUM BODY/BACK COVER
8. CENTER AXLE ASSEMBLY
9. FRONT BODY/FIRST LEG
10. FRONT FOOT
11. FRONT FOOT PAD
12. BATTERY FRAME
13. BACK FOOT WITH PAD
14. CIRCUIT BOARD
15. STEEL CLAMPING HOOKS FOR LOCK
16. BACK BODY/SECOND LEG
17. HEAT SINK
18. CHARGE INDICATOR LIGHTS
19. USB PORT COVER
20. POWER SWITCH
21. LOCKING PADDLE
22. RIGHT KNUCKLE
23. BACK ROTATING COVER (2)
24. DETENT
25. RATCHET GEAR
26. BATTERY
27. CENTER ROD
28. RIGHT RATCHET GEAR
29. LEFT RATCHET GEAR #2
30. LEFT KNUCKLE
31. FOOT ROD #1
32. FOOT ROD #2

One skilled in the art will fully understand the construction and operation of the clamping work from this FIG. 17 and the other figures. For purposes of this application, the numbers 1-32 of the component parts in FIG. 17 are solely for FIG. 17 based on a manufacturing drawing and other numbering and terminology will be used hereafter to discuss the clamping work light unless otherwise indicated.

Referring to FIGS. 1-20, the working clamp light 100 includes a housing 102 and a light 104. Housing 102 includes a first leg 120 and a second leg 122, preferably made of plastic. Legs 120 and 122 include feet 124 and 126, which feet are attached to said legs and are adapted to swivel to different positions when the light is to be clamped to an object. Feet 124 and 126 include a cross-check pad, preferably of rubber or plastic, as seen in FIG. 17 which allows for gripping of the feet to an object and avoid marring of a surface when the light is in a standing position. The feet 124 and 126 swivel from a closed position as shown, for example, in FIG. 4 to an open position as shown, for example, in FIG. 10, and the bottom 121 and 123 of legs 120 and 124, respectively, are constructed at an angle to stop movement of feet 124 and 126 by stops 121A/121B and 123A/123B. First leg 120 further includes a connector housing 127 attached to the first leg. Light 104 is attached to housing 127. Connector housing 127 includes the rotation assembly as discussed hereafter.

First leg 120 includes connecting members 128 for mating with corresponding connecting members 130 of second leg 122. These connecting members 128 and 130 are fastened by a screw or other fastening member to connect the first leg 120 and the second leg 122. There is a torsion spring 131 in each side of the light between the two flanges of connecting member 130 to provide torque for the clamping action of first and second legs 120 and 122. The spring 131 keeps first and second legs together as shown, for example, in FIGS. 1 and 4. When the light is rotated from a nesting position as shown in FIGS. 1-6 to a non-nesting position as shown in FIGS. 7-16, the top of first leg 120 and the top of second leg 122 are pushed toward each other to create an opening between the bottom portions of first and second legs for engaging an object.

Second leg 122 includes a locking mechanism 136 comprising a pivoting push member 138 and clamping hook 140 having hooks 142 and 144. Clamping hooks 142 and 144 are adapted to engage slots 146 and 148 in the back of first leg 120. When the top portions of first and second legs 120 and 122 are pushed together, the locking mechanism 136 may engage by pushing the bottom of push member 138 to place hooks 142 and 144 in slots 146 and 148 to engage the lock to place clamping work light 100 in a standing position as shown in FIGS. 7-16. To disengage the lock, the user pushes the top of push member 138.

Light 104 includes a housing 150 having a front cover 152 and a back cover 154, and preferably made of aluminum or a strong plastic. In a presently preferred embodiment, the light 104 is preferably generally hexagonal in shape and the housing 102 is constructed and arranged to be generally hexagonal in shape to receive light 104, while at the same time providing an aesthetically pleasing appearance. Front cover 152 includes a recess portion 156. In recess portion 156 there is a bezel 158 and a lens 160. The recess portion 156 and bezel 158 protect lens 160. Behind lens 160 is a COB LED light 162.

Back housing 154 includes an on/off switch 164 which will turn the light on or off or turn the light on to various illuminations and turn the light off. There is a charging port 166 for charging a rechargeable battery 26. There are also charge indicator lights 170 indicating the charge level of the battery. Switch 164, charging port 166 and indicator lights 170 are recessed into the back cover for a smooth contour and to protect these components. Light 104 will pivot on the first leg 120 from a nesting position in the housing 102 as shown in FIGS. 1-6 to a non-nesting position as shown in FIGS. 7-16 for directing the light to a work area. As discussed hereafter, the pivoting member is shown in detail in FIGS. 19-19B. Light 104 will also rotate 360 degrees on first leg 120 as seen, for example, in FIGS. 11, 12 and 16.

Figure 19:
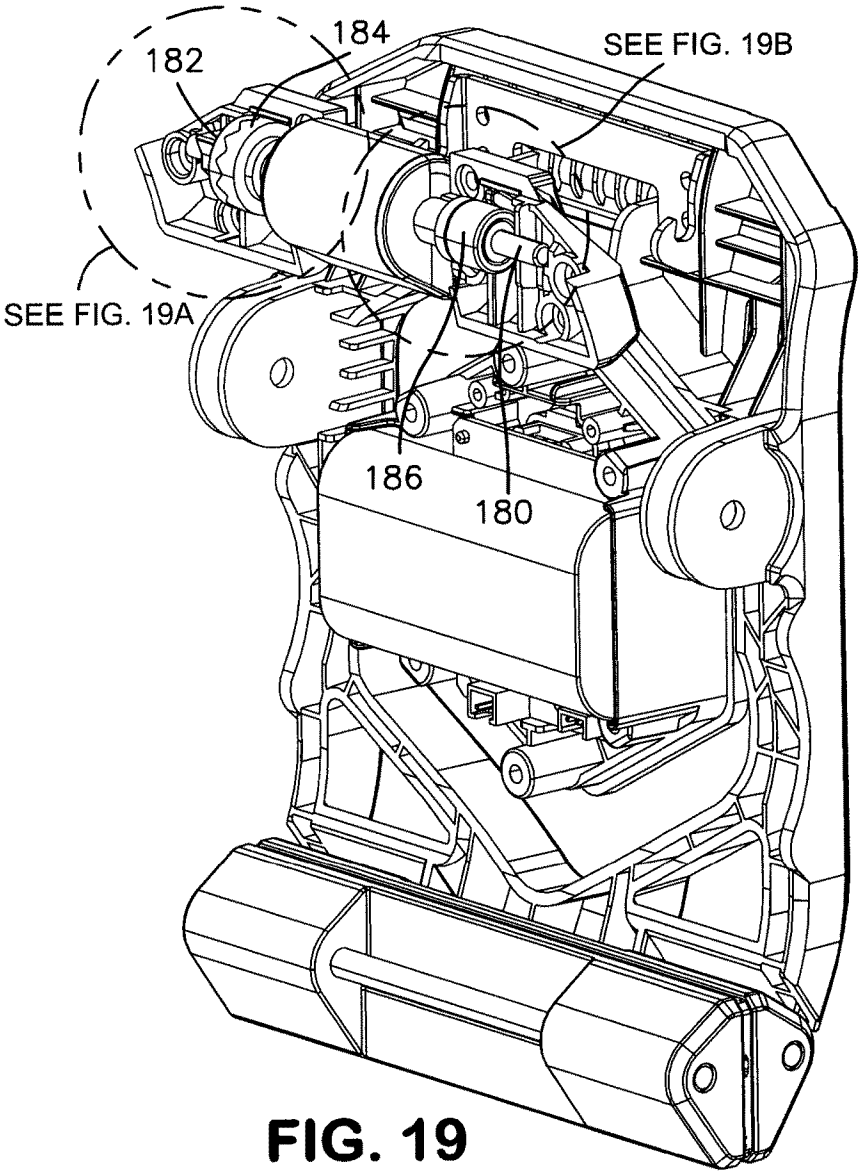
FIG. 19 is a cut-away of the clamping work light of FIG. 1 showing the pivoting assembly.
Figure 19A:
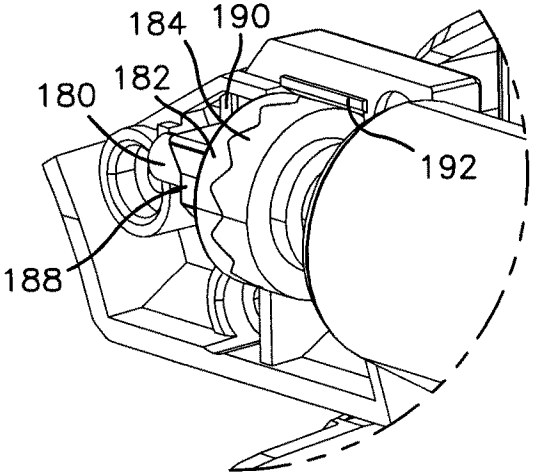
FIG. 19A is a detailed view of section 19A of FIG. 19.
Figure 19B:
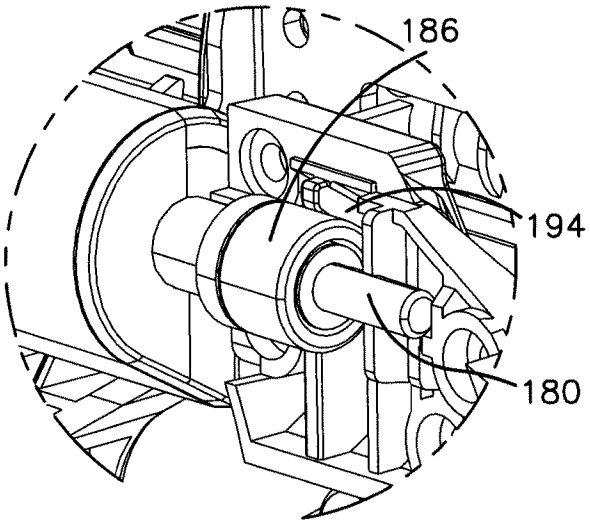
FIG. 19B is a detailed view of section 19B of FIG. 19.

Referring to FIGS. 17, 19, 19A and 19B, there is shown a presently preferred embodiment of the double-axis pivoting assembly for light 100. It is understood that other pivoting assemblies may be used without departing from the scope of the invention. Referring first to FIGS. 19-19B, there is shown the pivoting assembly for allowing light 104 to pivot vertically, including into and out of the housing 102. The pivoting assembly includes a rod 180 (center rod 27 in FIG. 17) and attached thereto is a first ratchet gear 182 and a second ratchet gear 184 (28 and 29 in FIG. 17) at one end of rod 180 and a roller 186 at the other end of rod 180. Rod 180 extends through housing 127. First ratcheting gear 182 includes a gear base 188 which fits in housing 190 in leg 120 and allows second ratcheting gear 184 to rotate which provides for the ratcheting pivoting movement of light 104. Ratcheting gears 182 and 184 fit into a corresponding shaped housing 192 to allow rotation of the ratcheting gears. Similarly, roller 186 fits into a correspondingly shaped housing 194 of leg 120. Referring to FIG. 17, the pivoting assembly for rotating light 104 360 degrees includes ratchet gear 25 which is connected to the base 194 of light 104 and detent 24 which engages gear 25 to provide for ratcheting rotational movement of light 104.

Figure 20:
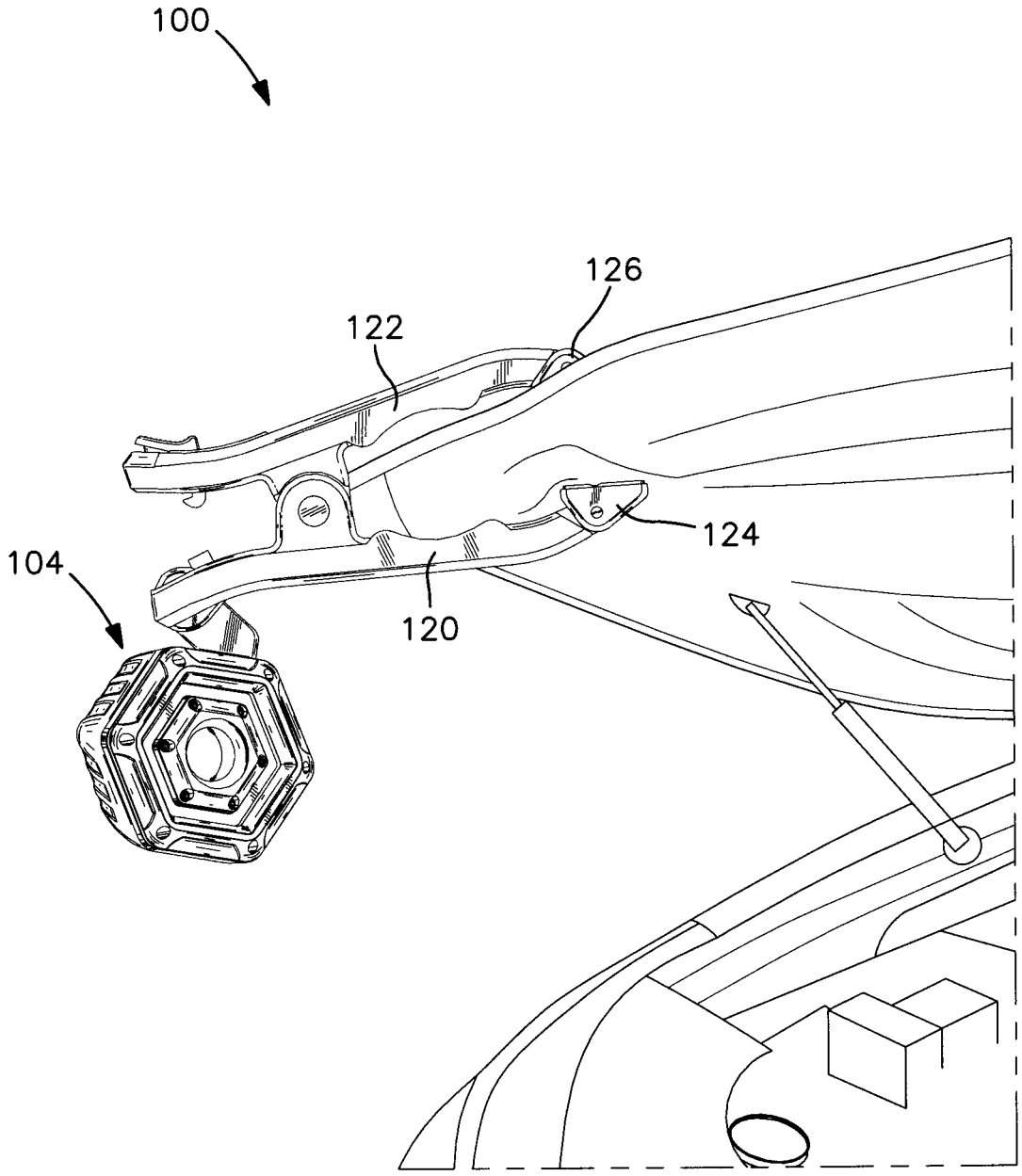
FIG. 20 shows the clamping work light of FIG. 1 attached to a car hood to direct light on the engine of the car.

As seen in FIGS. 1-6, the light 104 is shown nested in housing 102. The light may be turned on and off and used in this position and used similar to a regular portable light, including the pivoting movement of feet 124 and 126 to allow the nested light to stand on feet 124 and 126 (not shown). The light 104 may be pivoted to a non-nested position and thereafter clamped to an object as shown in FIG. 20, or placed in a standing position as shown in FIGS. 7-16. It is understood that light 104 may pivot in a number of different stop positions depending on where the light needs to be focused. When placing the light in standing position as shown in FIGS. 7-16, the top portions of first leg 120 and second leg 122 are pushed together and locking hooks 142 and 144 engage slots 146 and 148 to lock the legs in a standing position. Similarly, if the clamping work light 100 is to be clamped to an object such as shown in FIG. 20, the top portions of legs 120 and 122 are pushed together to open the bottom portion of legs 120 and 122 for engaging an object. Once the object is engaged, the top portion of legs 120 and 122 are released by the user and the pressure from springs 131 clamp the bottom portion of legs 120 and 122 to the object. Feet 124 and 126 swivel such that they can engage most surfaces of an object.

Referring to FIGS. 21-29, there is shown a second embodiment of a clamping work light. Like the light shown in FIGS. 1-20, this clamping work light includes a housing with a clamping mechanism designed into the housing and which allows the light to nest into the housing or rotate out of the housing and the light may be aimed in any direction by a double-axis pivoting assembly. This clamping work light provides for hands free lighting and allows for directing the light to a specific work area. This light may be a rechargeable light or a battery operated light or a corded light. This light differs from the clamping work light of FIGS. 1-20 primarily in that the light allows the clamping legs to be expanded much wider than the light of FIGS. 1-20. Additionally, this light will allow the lighting member to rotate on a first axis 360 degrees and rotate on a second axis 360 degrees. Further, the clamping legs will move outward and also vertically.

Figure 27:
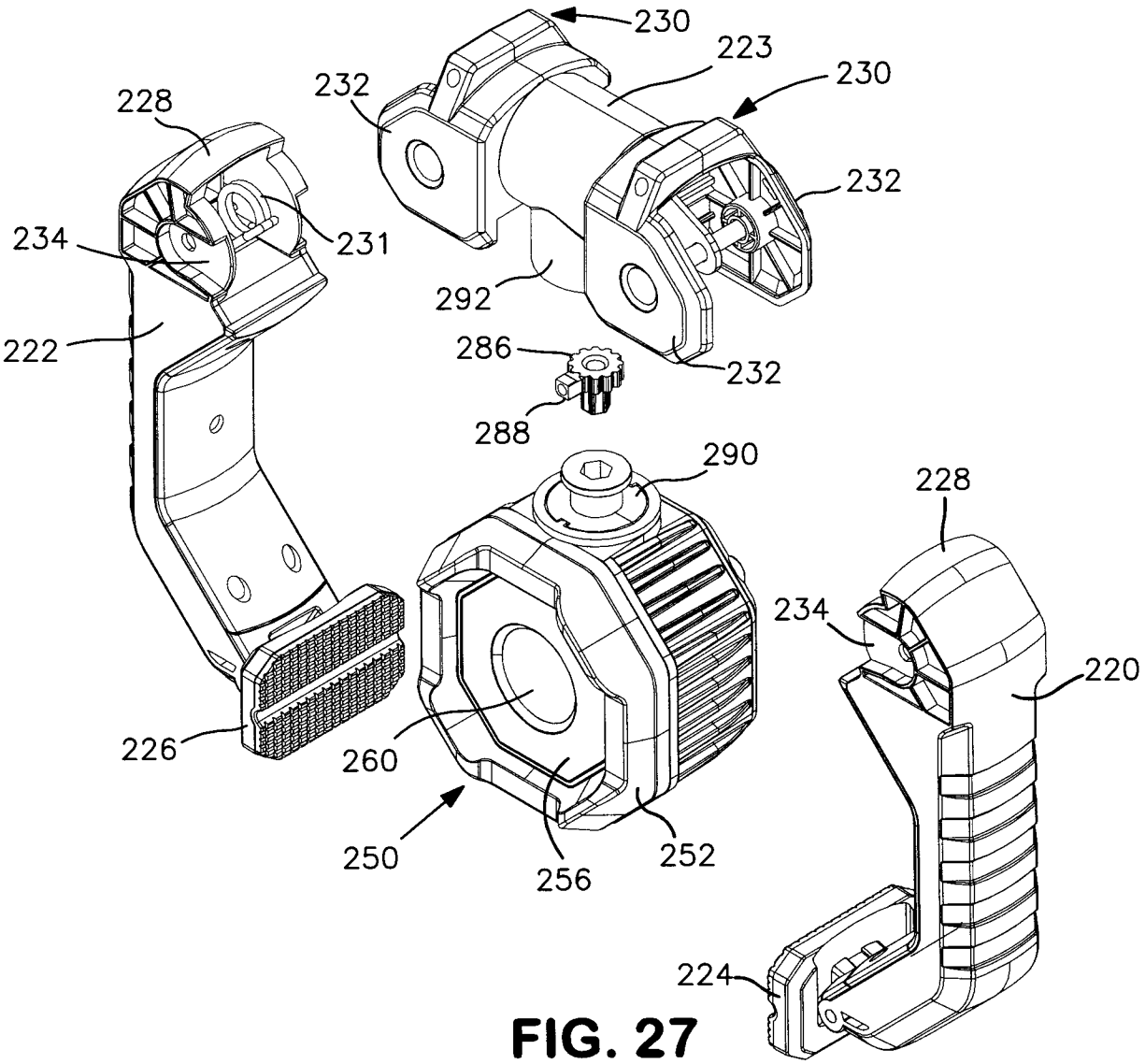
FIG. 27 is a partial exploded view of the clamping work light of FIG. 21.
Figure 28:
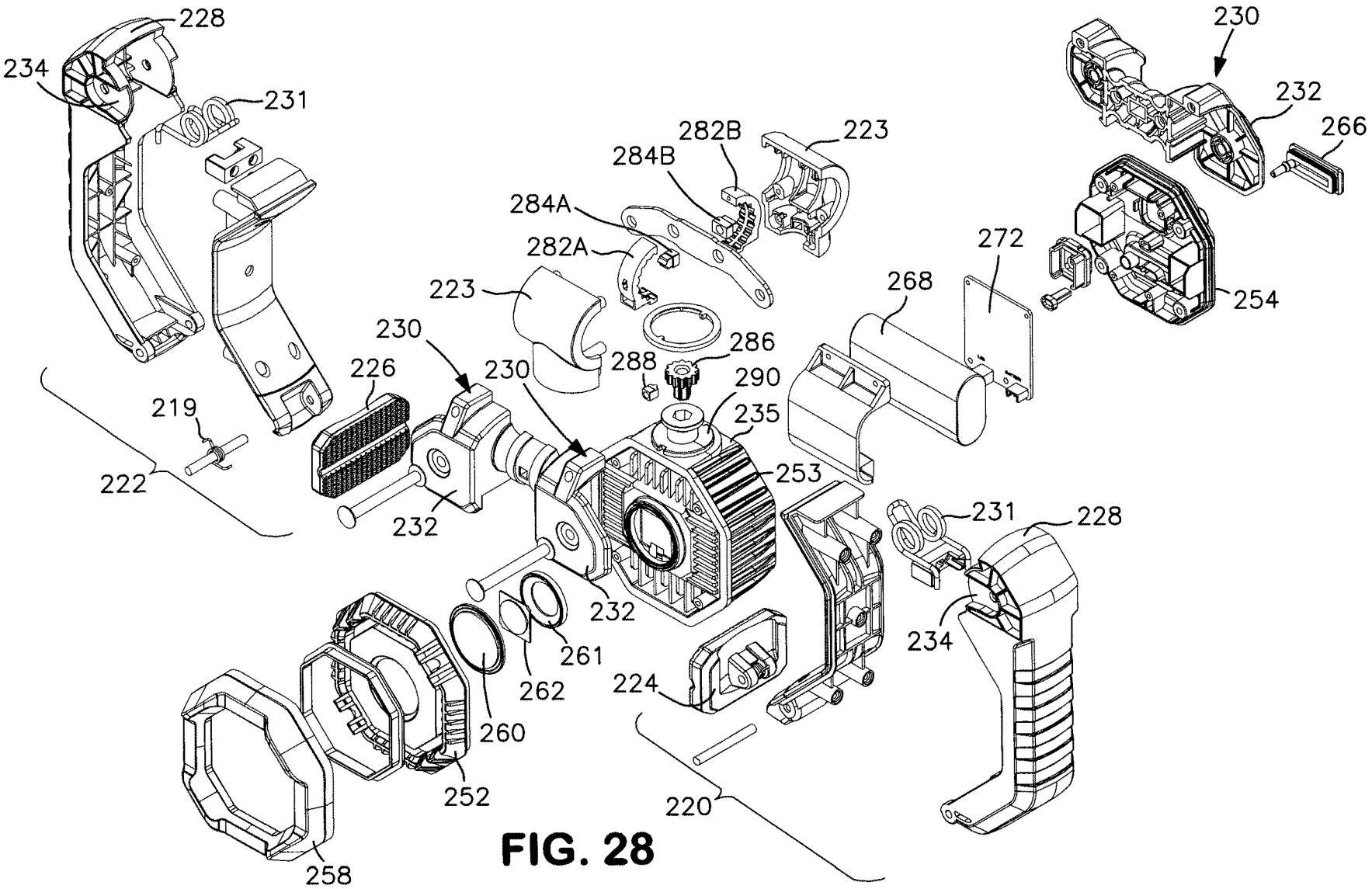
FIG. 28 is an exploded view of the clamping work light of FIG. 21.

Referring to FIGS. 21-29, the working clamp light 200 includes a housing 202 and a light 204. Housing 202 includes a first leg 220 and a second leg 222, first and second legs 220 and 222 having the same structure. Legs 220 and 222 include feet 224 and 226, which feet are attached to said legs and are adapted to swivel to different positions when the light is clamped to an object. Feet 224 and 226 include a cross-check pad (preferably of rubber or plastic) as seen in FIGS. 27 and 28 which allows for gripping of the feet to an object. Legs 220 and 222 and feet 224 and 226 may include a spring 219 to provide tension and flexibility to the swivel movement of the feet 224 and 226.

Figure 21:
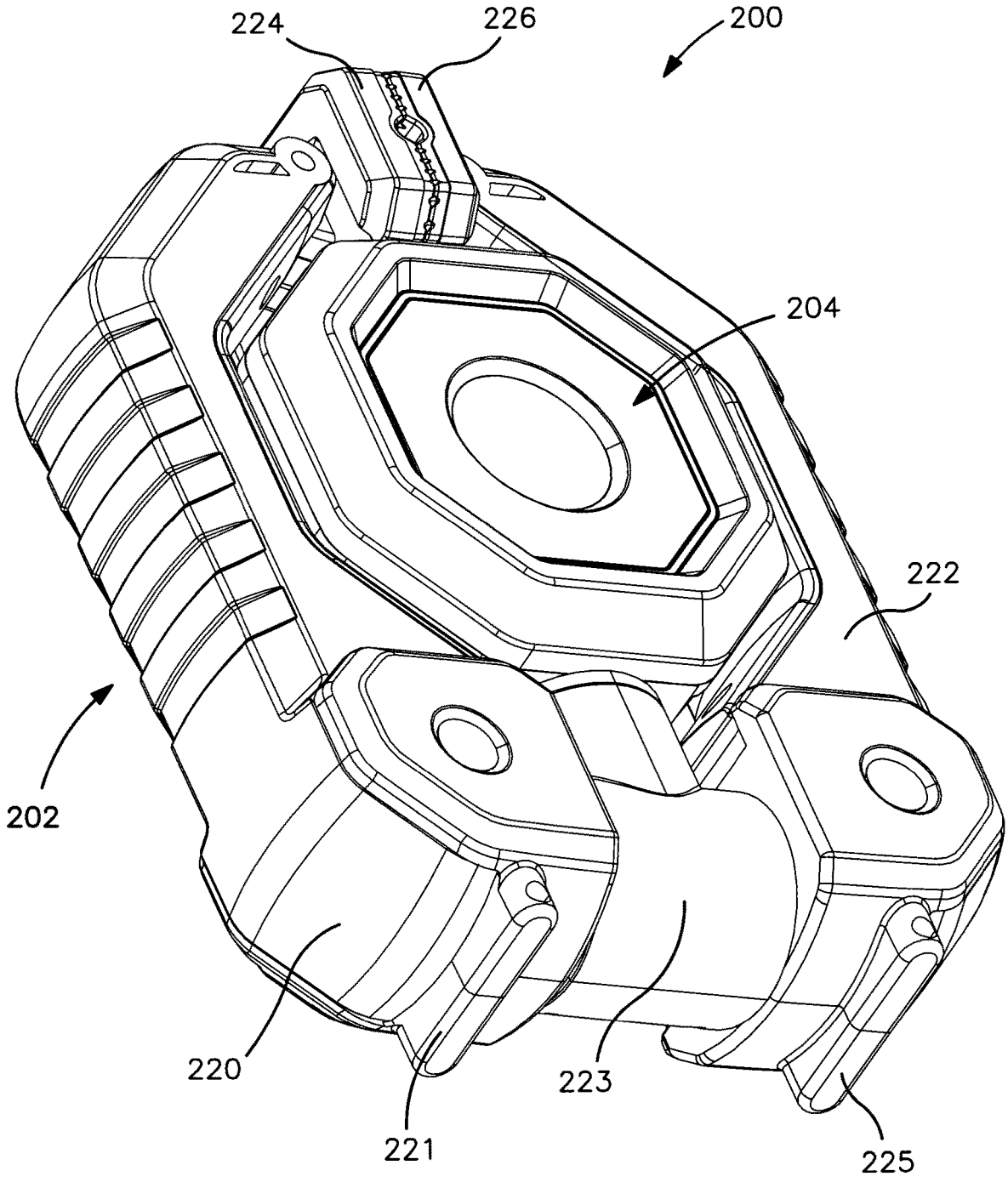
FIG. 21 is a front/side elevational perspective view of another embodiment of the clamping work light with the light in a nested position.
Figure 22:
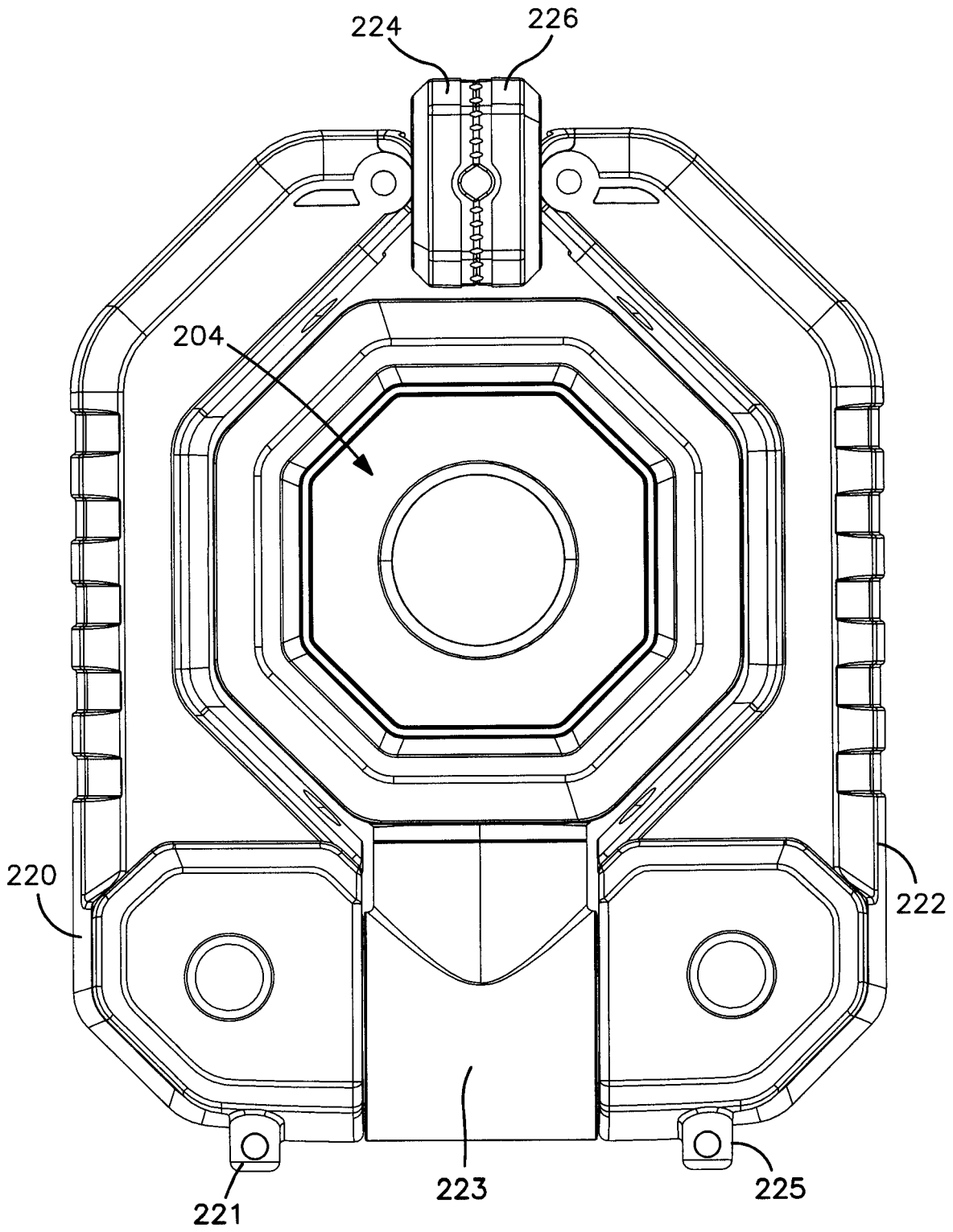
FIG. 22 is a front view of the clamping work light of FIG. 21.
Figure 23:
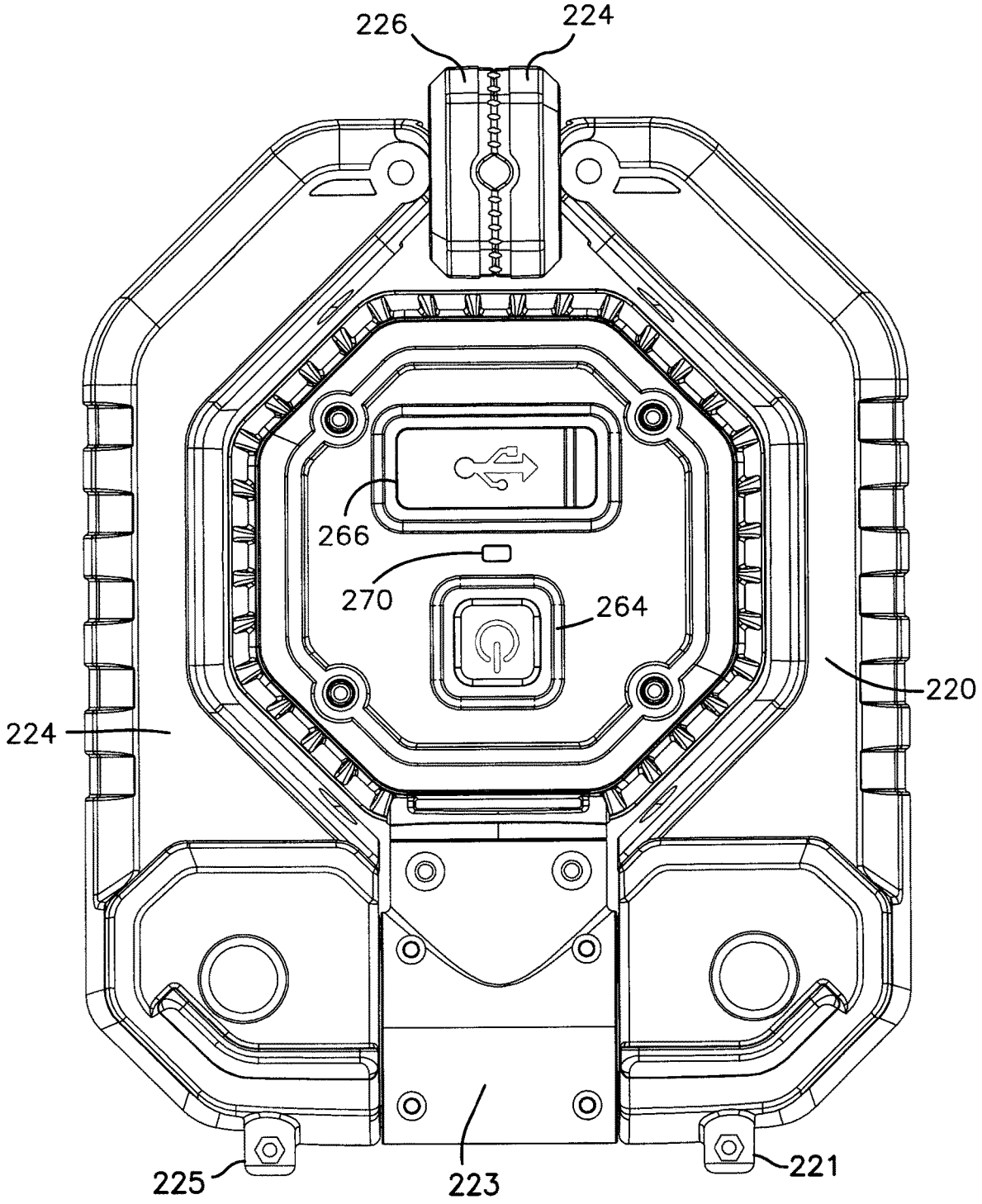
FIG. 23 is a rear view of the clamping work light of FIG. 21.
Figure 24:
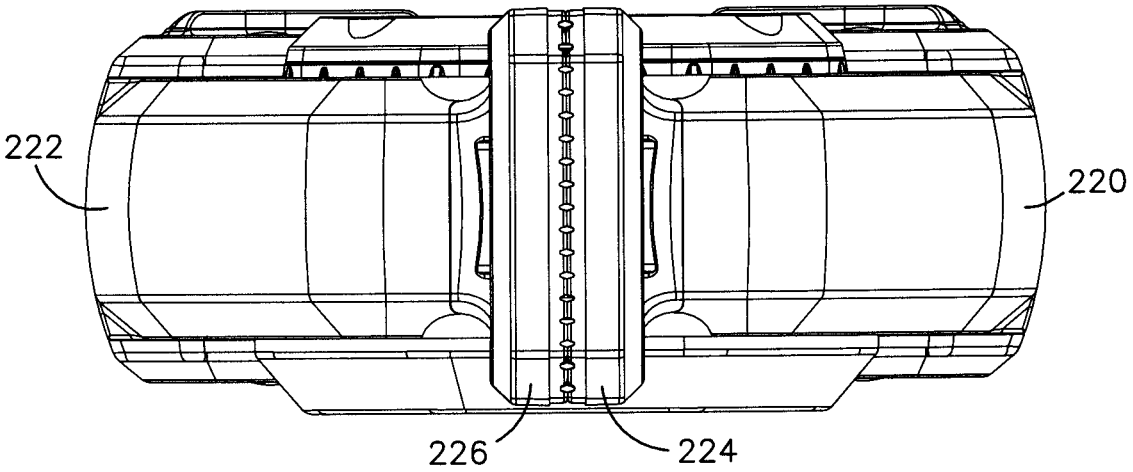
FIG. 24 is a top view of the clamping work light of FIG. 21.
Figure 25:
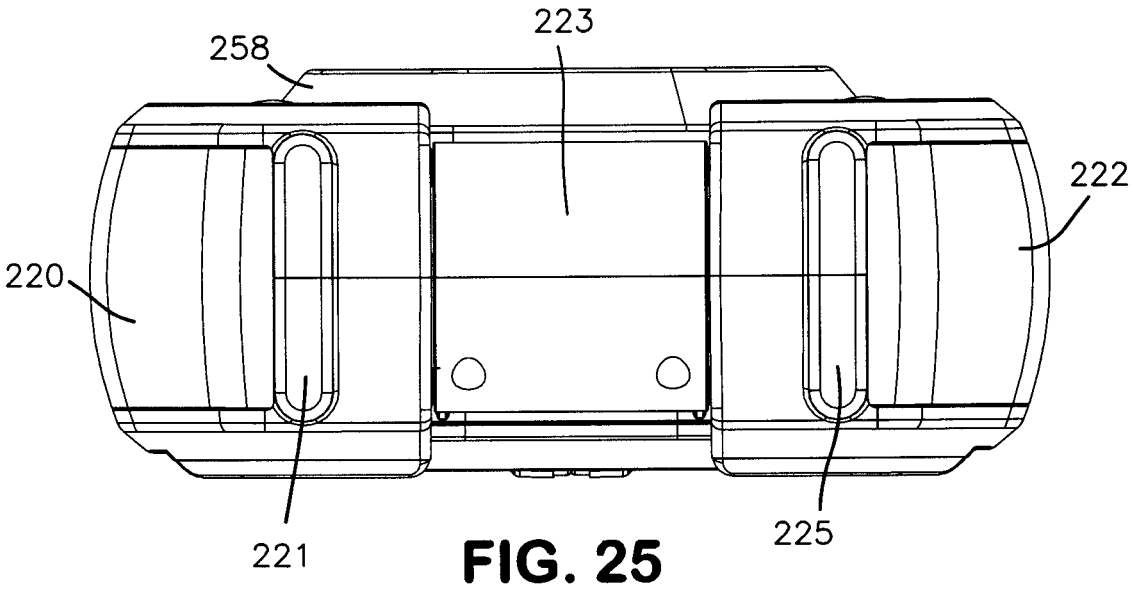
FIG. 25 is a bottom view of the clamping work light of FIG. 21.
Figure 26:
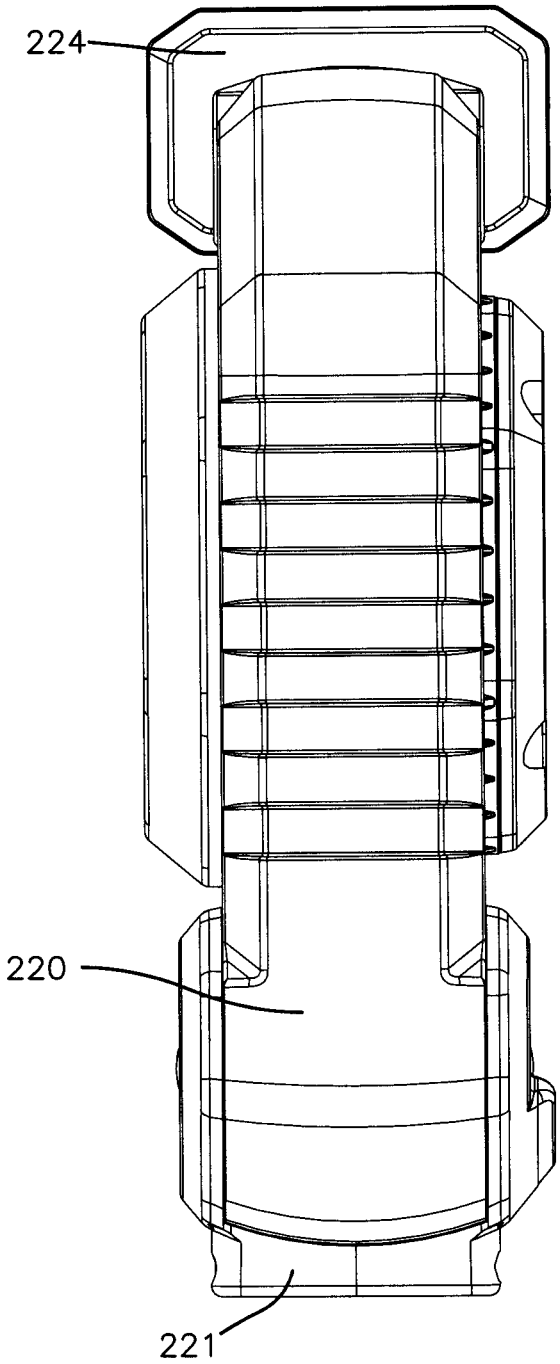
FIG. 26 is a side view of the clamping work light of FIG. 21, the opposite side view being a mirror image.
Figure 29:
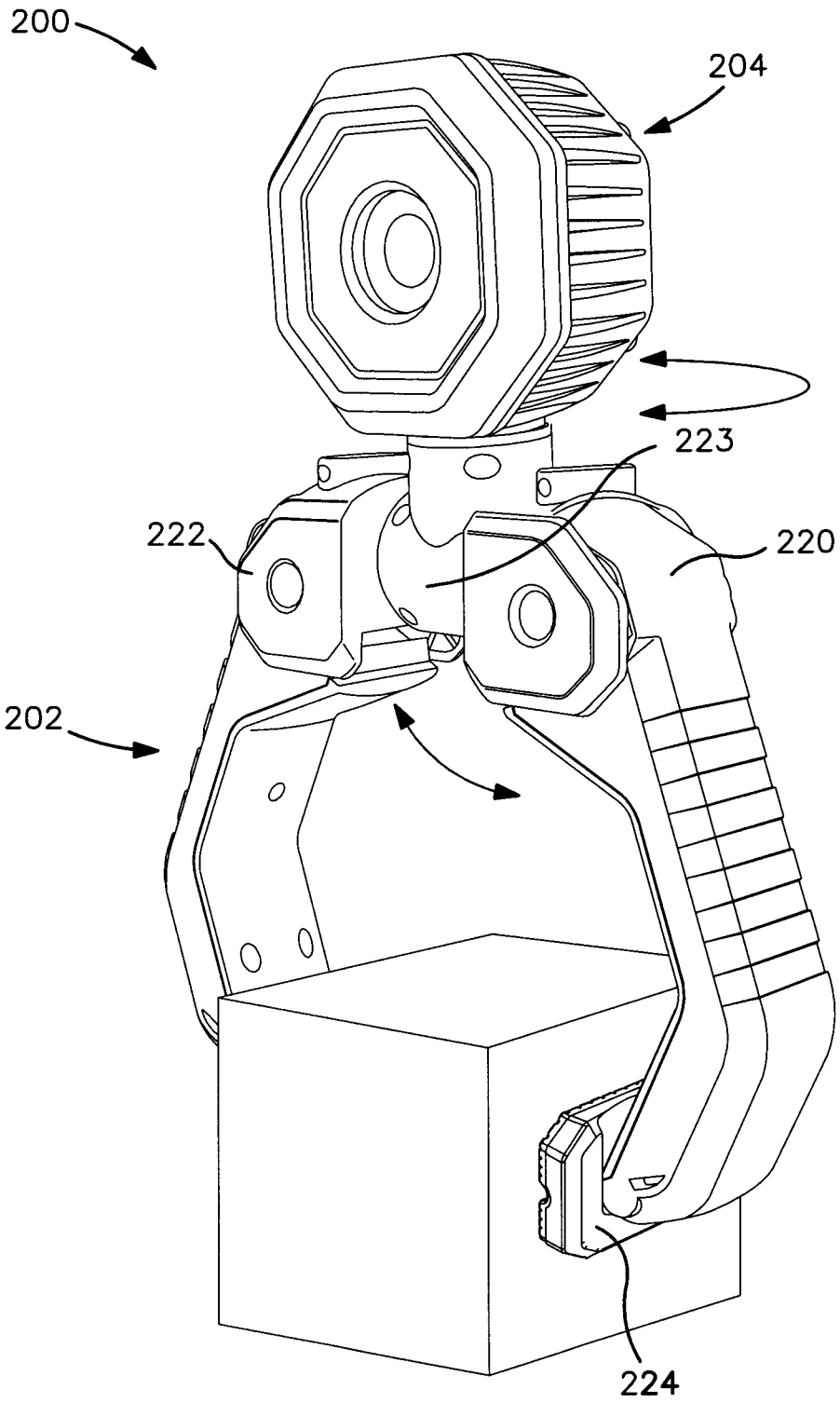
FIG. 29 shows the clamping work light of FIG. 21 in a non-nested position clamped to an object.

First leg 220 and second leg 222 include connecting members 228 for mating with corresponding connecting members 230 of connector housing 223. Connecting member 230 with flanges 232 fit over and connect to ears 234 of connecting members 228. These connecting members 228 and 230 are fastened by a screw or other fastening member to attach the first leg 220 and second leg 222 to connector housing 223. There is a spring 231 in each of legs 220 and 222 to provide torque for the clamping action of first and second legs 220 and 222. The spring 231 keeps first and second legs together as shown, for example, in FIG. 21. When the light is rotated from a nesting position as shown in FIG. 21 to a non-nesting position as shown in FIG. 29, first leg 220 and second leg 222 are pulled away from each other to create an opening between the feet portions of the first and second legs for engaging an object. Additionally, legs 220 and 222 are adapted to move vertically a short distance due to spring 231 for ease of clamping to an object.

Light 204 includes a housing 250 having a front cover 252, a housing 253 and a back cover 254. Front cover 252 includes a recess portion 256. In recess portion 256 there is a bezel 258, a lens 260 and reflector 261. Behind lens 260 is a COB LED light 262.

Housings 253 and 254 includes an on/off switch 264 which will turn the light on or off or turn the light on to various illuminations and turn the light off. There is a charging port 266 for charging a rechargeable battery 268. There is also a charge indicator light 270 indicating when the battery is charging, flashing red light, and when the battery is charged, a green light. The electronics are controlled by a circuit board 272. Light 204 will pivot on connector 223 about the first and second legs 220 and 222 from a nesting position in the housing 202 as shown in FIGS. 21-25 to a non-nesting position as shown in FIG. 29 for directing the light to a work area. The light 204 may pivot 360 degrees. Light 204 will also rotate 360 degrees on connector 223 as seen in FIG. 29. The pivoting and rotating members are shown in detail in FIGS. 27 and 28 and discussed hereafter.

Referring to FIGS. 27 and 28, there is shown a presently preferred embodiment of the double-axis pivoting assembly for light 200. It is understood that other pivoting assemblies may be used without departing from the scope of the invention. Referring first to FIG. 27, there is shown the pivoting assembly for allowing light 204 to pivot vertically, including into and out of the housing 202. The pivoting assembly is in connector housing 223 and includes gears 282A and 282B which fit in connector housing 223 and detents 284A and 284B which work in conjunction with each other to provide a ratcheting movement thereby providing the pivoting movement of light 204. Referring to FIGS. 27 and 28, the pivoting assembly for rotating light 204 360 degrees includes ratchet gear 286 which is connected to the base 290 of light 204 and detent 288 which engages gear 286 to provide for ratcheting rotational movement of light 204. Detent 288 is in collar 292 of connector housing 223 and attached to light 204.

As seen in FIGS. 21-25, the light 204 is shown nested in housing 202. The light may be turned on and off and used in this position and used similar to a regular portable light, e.g. resting on mounts 221 and 225 of legs 220 and 222; or the light 204 may be pivoted to a non-nested position and thereafter clamped to an object as shown in FIG. 29, or placed in a standing position on feet 224 and 226 (not shown). It is understood that light 204 may pivot in a number of different stop positions depending on where the light needs to be focused. If the clamping work light 200 is to be clamped to an object such as shown in FIG. 29, legs 220 and 222 are pulled apart for engaging an object. Once the object is engaged, the pressure from springs 231 clamp the bottom portion of legs 220 and 222 to the object. Feet 224 and 226 swivel such that they can engage most surfaces of an object.

The clamping work light of the invention provides for an easy to use light capable of directing the light source to specific areas of use. The clamping work light is compact and easy to handle and use.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A clamping work light which may clamp to an object or be free standing comprising a housing having a first leg and a second leg; said first leg and said second leg each comprising a top member and side members extending downwardly from said top member and constructed and arranged to have an open area between said side members and adapted to receive a light in a nested position in said open area; said housing including a first pivoting assembly allowing said light to pivot out of said open area to a plurality of non-nested positions and a second pivoting assembly allowing said light to rotate 360 degrees when in the non-nested position; said housing including means to allow said first and second legs to clamp to an object or to be free standing.

2. The clamping work light of claim 1 wherein said first leg and said second leg include pivoting feet.

3. The clamping work light of claim 2 wherein said pivoting feet include a pad having a cross-checked pattern.

4. The clamping work light of claim 3 wherein said pad is made of rubber or plastic.

5. The clamping work light of claim 1 wherein said light is connected to said first leg.

6. The clamping work light of claim 5 wherein said second leg includes at least one hook member and said first leg includes at least one slot member wherein said hook member and said slot member are adapted to engage each other for placing said light in a locked standing position.

7. The clamping work light of claim 6 wherein said at least one hook member is adapted to move to engage said at least one slot member by a push member.

8. The clamping work light of claim 1 wherein the bottom of said feet members are adapted to engage each other when said light is in the nested position.

9. The clamping work light of claim 1 wherein said first pivoting assembly provides for ratcheting pivoting movement and said second pivoting assembly provides for ratcheting rotational movement.

10. The clamping work light of claim 9 wherein said first pivoting assembly comprises a first ratcheting gear having a gear base adapted to engage a housing of said first leg and a second ratcheting gear which engages said first ratcheting gear and adapted to rotate to provide said ratcheting pivoting movement.

11. The clamping work light of claim 10 wherein said second pivoting assembly comprises a ratcheting gear connected to a base of said light and a detent connected to a housing in said first leg, wherein said detent is adapted to engage said ratcheting gear in said housing to provide said ratcheting rotational movement.

12. The clamping work light of claim 1 wherein said light is hexagonal in shape.

13. The clamping work light of claim 12 wherein said light comprises a front cover having an LED light; a back housing; a protective housing for said LED light comprising an annular housing having a recess area which decreases in diameter from the top of said annular housing to the inside bottom of said annular housing and a lens.

14. The clamping work light of claim 13 wherein the lens comprises a lens assembly having a beveled lens.

15. The clamping work light of claim 14 further comprising a USB port for outbound charging.

16. The clamping work light of claim 15 further comprising battery charge level indicator.

17. The clamping work light of claim 1 wherein when the light is pivoted to a non-nesting position, the first leg and the second leg are adapted to be pulled apart to clamp to an object.

* * * * *